US007024336B2

(12) United States Patent
Salsbury et al.

(10) Patent No.: US 7,024,336 B2
(45) Date of Patent: Apr. 4, 2006

(54) METHOD OF AND APPARATUS FOR EVALUATING THE PERFORMANCE OF A CONTROL SYSTEM

(75) Inventors: Timothy I. Salsbury, Whitefish Bay, WI (US); Ashish Singhal, Glendale, WI (US)

(73) Assignee: Johnson Controls Technology Company, Holland, MI (US)

( * ) Notice: Subject to any disclaimer, the term of this patent is extended or adjusted under 35 U.S.C. 154(b) by 15 days.

(21) Appl. No.: 10/844,663

(22) Filed: May 13, 2004

(65) Prior Publication Data

US 2005/0256661 A1 Nov. 17, 2005

(51) Int. Cl.
*G06F 19/00* (2006.01)

(52) U.S. Cl. ..... 702/182; 700/26

(58) Field of Classification Search ..... 702/182, 702/183–185, 188; 700/26; 714/25
See application file for complete search history.

(56) References Cited

U.S. PATENT DOCUMENTS 4,769,817 A * 9/1988 Krohn et al. ..... 714/33
5,619,453 A * 4/1997 Roohparvar et al. ... 365/185.33
2005/0103874 A1* 5/2005 Erdman, Jr. ..... 236/51

OTHER PUBLICATIONS

Basseville, Michele et al., "Detection of Abrupt Changes: Theory and Application", This book was previously published by Prentice-Hall, Inc., 1998.

Cao, Songling et al., "Critical values for a steady-state identifier", *Journal of Process Control*, Apr. 1997, pp. 149-152, vol. 7, No. 2.

Cao, Songling et al., "An efficient method for on-line identification of steady state", *Journal of Process Control*, Dec. 1995, pp. 363-374, vol. 5, No. 6.

Desborough, Lane et al., Industrial Computing, www.isa.org/journals/ic, Aug. 2001, pp. 52-55.

Forsman, Krister et al., "A new criterion for detecting oscillations in control loops", In Proc. European Control Conference, 1999, 5 pgs.

Horch, Alexander, "A simple method for detection of stiction in control valves", (Royal Institute of Technology) Source: Control Engineering Practice, Oct. 1999, pp. 1221-1231, vol. 7, No. 10.

(Continued)

*Primary Examiner*—Edward Raymond
(74) *Attorney, Agent, or Firm*—Foley & Lardner LLP

(57) ABSTRACT

A method for and apparatus for evaluating the performance of a control system are disclosed. The method includes receiving data from the control system, wherein the data is received by a passive testing function, and calculating a parameter related to the performance of the control system using the passive testing function. The apparatus includes a processor operable to execute a passive testing function, wherein the passive testing function is configured to receive data from the control system and calculate a parameter related to the performance of the control system. The apparatus may also include an active testing function, wherein the active testing function is configured to provide a sequence of step changes to an input of the control system, receive data from the control system in response to the sequence of step changes, and calculate a parameter related to the performance of the control system.

44 Claims, 23 Drawing Sheets

OTHER PUBLICATIONS

Horch, Alexander et al., "A method for detection of stiction in control valves", *Royal Institute of Technology*, Jul. 1998, 7 pgs.
Marchetti, G. et al., "Identification and Control of Open-Loop Unstable Processes by Relay Methods", *Automatica*, Jun. 2001, pp. 1-6.
Montgomery, Douglas C. et al., "Some Statistical Process Control Methods for Autocorrelated Data", *Journal of Quality Technology*, Jul. 1991, pp. 179-193, vol. 23, No. 3.
Paulonis, Michael A. et al., "A practical approach for large-scale controller performane assessment, diagnosis, and improvement", *Journal of Process Control*, 2003, pp. 155-168, vol. 13.
Rhinehart, R. Russell, "A statistically based filter", *ISA Transactions*, Apr. 2002, pp. 167-175, vol. 41, No. 2.
Rhinehart, R. Russell, "A CUSUM type on-line filter", *Process Control and Quality*, 1992, pp. 169-176, vol. 2.
Sagara, Setsuo et al., "Numerical Integration Approach to On-line Identification of Continuous-time Systems", *Automatica*, Jan. 1990, pp. 63-74, vol. 26, No. 1.
Thornhill, N.F. et al., "Refinery-wide control loop performance assessment", *Journal of Process Control*, Apr. 1999, pp. 109-124, vol. 9, No. 2.
Thornhill, N.F. et al., "Detection of Distributed Oscillations and Root-Cause Diagnosis", CHEMFAS4, believed to be available prior to the filing date of May 13, 2004, pp. 1-6.
Tunewizard By Plant Automation Services, Inc., "Control loop optimization made simple!", http://www.tunewizard.com/ (1 of 3) [Apr. 29, 2003 9:28:38 AM], believed to be available prior to May 13, 2004, 35 total pgs.
Vachhani, Pramod et al., "A framework for integrating diagnostic knowledge with nonlinear optimization for data reconcilation and parameter estimation in dynamic systems", *Chemical Engineering Science*, 2001, pp. 2133-2148, vol. 56.
Agarwal, M., and C. Canudas, 1987, "On-line Estimation of Time Delay and Continuous-Time Process Parameters", International Journal of Control, vol. 46, No. 1, pp. 295-311.
Aström, K., T. Hägglund, 1995, "PID Controllers, 2nd Edition". Published by the Instrument Society of America, ISBN 1-55617-516-7. pp. 49-50.
Bezergianna, S., C. Georgakis, 2000, "Controller Perfomance Assessment Based on Minimum and Open-Loop Output Variance", Control Engineering Practice, vol. 8, pp. 791-797.
Bi, Q., W. Cai. E. Lee, Q. Wang, C. Hang, Y. Zhang, 1999, "Robust Identification of First-Order Plus Dead-Time Model from Step Response", Control Engineering Practice, No. 7, pp. 71-77.
Bokor, E. V., Keviczky, L., 1985, "Recursive Structure, Parameter, and Delay Time Estimation using ESS Representations", Proceedings of the 7th IFAC Symposium on Identification and System Parameter Estimation, York, UK, pp. 867-872.
Desborough, L., T. Harris, 1992, "Performance Assessment Measures for Univariate Feedback Control", The Canadian Journal of Chemical Engineering, vol. 70, pp. 1186-1197.
Eriksson, P., A. J. Isaksson, 1994, "Some Aspects of Control Loop Performance Monitoring", The 3rd IEEE Conference on Control Applications, Glasgow, Scotland, pp. 1029-1034.
Frank, P. M., 1990, "Fault Diagnosis in Dynamic Systems Using Analytical and Knowledge-Based Redundancy—A Survey and Some New Results", Automatica, vol. 26, No. 3, pp. 459-474.
Hägglund, T., 1999, "Automatic Detection of Sluggish Control Loops", Control Engineering Practice, vol. 7, pp. 1505-1511.
Hägglund, T., 1995, "A Control Loop Performance Monitor", Control Engineering Practice, vol. 3, pp. 1543-1551.
Hägglund, T. and K. J. Aström, 1991, "Industrial Adaptive Controllers Based on Frequency Respone Techniques", Automatica, vol. 27, pp. 599-609.
Hägglund, T., K. Aström, 2002, "Revisiting the Ziegler-Nichols Tuning Rules for PI Control", Proceedings of the UCSB Process Control Consortium, pp. 364-380.
Harris, T. J., 1989, "Assessment of Control Loop Performance", Canadian Journal of Chemical Engineering, vol. 67, pp. 856-861.
Horch, A., 2000, "Condition Monitoring of Control Loops", Ph.D., Thesis, Royal Institute of Technology, Sweden, ISBN 91-7170-638-0, 216 pages, including cover page.
Horch, A., A. J. Isaksson, 1999, "A Modified Index for Control Performance Assessment", Journal of Process Control, vol. 9, p. 475-483.
Ingimundarson, A., T. Hägglund, 2001, "Closed Loop Identification of First-Order Plus Dead Time Model with Method of Moments", Department of Automatic Control, Lund Institute of Technology, Sweden, Internal Report, 6 pages.
Isermann, R., 1992, "Adaptive Control Systems", Published by Prentice Hall, Englewood Cliffs, NJ, pp. 387-404.
Johansson, R., 1986, "Identification of Continuous-Time Dynamic Systems", Proceedings of the 25th IEEE Conference on Decision and Control, pp. 1653-1658.
Kaminskas, V., 1979., "Parameter Estimation in Systems with Time Delay and Closed Loop Systems", 5th IFAC Symposium on Identification and System Parameter Estimation, Darmstadt, vol. 1, pp. 669-677.
Krishnaswamy, P. R., B. E. M. Chan, and G. P. Rangaiah, 1987, "Closed Loop Tuning of Process Control Systems", Chemical Engineering Science, vol. 42, No. 9, pp. 2173-2182.
MacGregor. J. F., T. J. Harris. 1993. "The Exponentially Weighted Moving Variance". Journal of Quality Technology. vol. 25. No. 2. pp. 106-118.
Miao, T., D. E. Seborg. 1999. "Automatic Detection of Excessively Oscillatory Feedback Control Loops". Proceedings of the 1999 IEEE International Conference on Control Applications. Hawaii, USA, pp. 359-364.
Nishikawa, Y., N. Sannomiya, T. Ohta, and H. Tanaka, 1984, "A Method for Autotuning of PID Controller Parameters", Automatica, vol. 20, pp. 321-332.
Pupeikis, R., 1985, "Recursive Estimation of the Parameters of Linear Systems with Time Delay", Proceedings of the 7th IFAC Symposium on Identification and System Parameter Estimation, York, UK, pp. 787-792.
Rao, G. P., L. Sivakumar, 1976, "Identification of Deterministic Time-lag Systems", IEEE Transactions on Automatic Control, vol. 21, pp. 527-529.
Rhinehart, R., 1995, "A Watchdog for Controller Performance Monitoring", Proceedings of the American Controls Conference, Seattle, Washington, pp. 2239-2240.
Seem, J., 1999, "A New Pattern Recognition Adaptive Controller with Application to HVAC Systems", Automatica, vol. 34, No. 8, pp. 969-982.
Söderström, T., P. Stoica, 1981, "Comparison of Some Instrumental Variable Methods—Consistency and Accuracy Aspects", Automatica, vol. 17, No. 1, pp. 101-115.

Stanfelj, N., T. Marlin, J. MacGregor, 1993, "Monitoring and Diagnosing Process Control Performance: The Single Loop Case", Ind. Eng. Chem. Res., vol. 32, pp. 301-314.
Sundaresan, K. R., P. R. Krishnaswamy, 1978, "Estimation of Time Delay Time Constant Parameters in Time, Frequency, and Laplace Domains", The Canadian Journal of Chemical Engineering, vol. 56, pp. 257-262.
Swanda, A., D. E. Seborg, 1997, "Evaluating the Performance of PID-type Feedback Control Loops Using Normalized Settling Time", ADCHEM '97, IFAC, Banff, Canada, pp. 301-306.
Taiwo, O., 1993, "Comparison of Four Methods of Online Identification and Controller Tuning", IEE Proceedings, Part D, vol. 140, No. 5, pp. 323-327.
Thornhill, N. F., J. W. Cox, M. A. Paulonis, 2003, "Diagnosis of Plant-Wide Oscillation through Data-Driven Analysis and Process Understanding", Control Engineering Practice, No. 11, pp. 1481-1490.
Vaught, R., J. Tippet, 2001, "Control Performance Monitoring: Shaman or Saviour", Pulp and Paper Canada, vol. 109, No. 9, pp. 26-29.
Venkataramanan, G., V. Shukla, R. Saini, R. R. Rhinehart, 1997, "An Automated On-line Monitor of Control System Performance", American Controls Conference, Albuuquerque, New Mexico, pp. 1355-1359.
Young, P., 1965, "Process Parameter Estimation and Self-Adaptive Control", Proceedings of the Second IFAC Symposium on the Theory of Self-Adaptive Control Systems, Teddington, England, pp. 118-140.
Young, P., 1970, "An Instrumental Variable Method for Real-Time Identification of a Noisy Process", Automatica, vol. 6, pp. 271-285.
Young, P., 1981, "Parameter Estimation for Continuous-Time Models—A Survey", Automatica, vol. 17, No. 1, pp. 23-39.
Yuwana, M. and D. E. Seborg, 1982, "A New Method for Online Controller Tuning", AIChE Journal, vol. 28, No. 3, pp. 434-440.

* cited by examiner

METHOD OF AND APPARATUS FOR EVALUATING THE PERFORMANCE OF A CONTROL SYSTEM

BACKGROUND

The present description relates generally to methods of and apparatuses for evaluating the performance of a control system. More specifically, the present description relates to automated methods of and apparatuses for evaluating the performance of a control system which utilize a series of tests, such as standardized tests.

It is known to use feedback control loops in modern heating, ventilating, and air-conditioning (HVAC) control systems and proportional plus integral action is the most commonly employed control law. Despite the prevalence of this standard and well-understood control strategy, building performance is frequently hampered by poorly performing feedback control loops. System controllers utilizing feedback control loops are often badly tuned, which may lead to sluggish or oscillating system responses. Other times, the plant (i.e., the device or other part of the system to be controlled) deteriorates or malfunctions to such a degree that it can no longer be controlled. In the latter case, bad tuning might be suspected and extensive time may be expended trying to re-tune the loop before discovering that the system cannot be controlled with proportional plus integral action.

Commissioning typically relates to testing and verifying the performance of a feedback control loop. Performing proper commissioning could eliminate many of the problems with feedback control loops in control systems. Commissioning is normally performed after control systems have been installed and before they are brought into full operation while there is still an opportunity to perform tests to verify acceptable performance. This opportunity is often not taken advantage of due to time constraints, limited availability of skilled personnel, a large number of control loops and large amounts of data, and a lack of standardized and repeatable test procedures. The result of inadequate commissioning is that installation, configuration, and tuning problems are not identified and then persist, sometimes throughout the life of the buildings.

Many commissioning-type problems may not be detected during the life of a building due to the effect of compensatory action between interacting control systems. For example, a heating coil further downstream may mask a leaking cooling valve in a duct system. Or a faster reacting loop may be masking the oscillations in a slower loop. Often a problem is only deemed to exist when occupants are dissatisfied or energy use is significantly affected and in many cases only the severest problems will be noticed. Further, once a problem is detected during the normal operation of a building, the same kind of issues that were faced during commissioning arise once again. For example, there are time constraints, due to cost, for fixing the problem; a lack of skilled personnel; large numbers of control loops generating overwhelming amounts of data, and a lack of standardized tests.

In view of the foregoing, it would be desirable to provide a method of and apparatus for evaluating the performance of a control system, such as a control loop in an HVAC system, that makes the adoption of more rigorous commissioning and troubleshooting more practicable and less time consuming by utilizing automated standardized test procedures which may be carried out in parallel on multiple feedback control loops.

Additionally, many system controllers operate as regulators with fixed setpoints, and for some types of control systems, the artificial introduction of a setpoint change for purposes of performance assessment may be impractical. For other systems, little or no information about certain control system parameters may be available. Thus, it would further be desirable to provide a method of and apparatus for evaluating the performance of a control system which provides not only invasive testing techniques, but also non-invasive testing techniques which do not disturb normal operation of the control system. It would also be desirable to provide a method of and apparatus for evaluating the performance of a control system which requires little or no prior information about a particular feedback control loop.

SUMMARY

According to an exemplary embodiment, a method of evaluating the performance of a control system includes receiving data from the control system, wherein the data is received by a passive testing function, and calculating a parameter related to the performance of the control system using the passive testing function.

According to another exemplary embodiment, an apparatus for evaluating the performance of a control system includes a processor operable to execute a passive testing function, wherein the passive testing function is configured to receive data from the control system and calculate a parameter related to the performance of the control system.

According to another exemplary embodiment, an apparatus for evaluating the performance of a control system includes means for executing a passive testing function, wherein the passive testing function is configured to receive data from the control system and calculate a parameter related to the performance of the control system.

According to another exemplary embodiment, an apparatus for evaluating the performance of a control system includes a processor operable to execute an active testing function, wherein the active testing function is configured to provide a sequence of step changes to an input of the control system, receive data from the control system in response to the sequence of step changes, and calculate a parameter related to the performance of the control system.

According to another exemplary embodiment, a method of evaluating the performance of a control system includes receiving data from the control system; wherein the data is received by a passive testing function, and wherein the passive testing function is at least one of a load disturbance detection test and an oscillation detection test. The method also includes calculating a parameter related to the performance of the control system using the passive testing function.

According to another exemplary embodiment, an apparatus for evaluating the performance of a control system includes a processor operable to execute a passive testing function, wherein the passive testing function is at least one of a load disturbance detection test and an oscillation detection test, and wherein the passive testing function is configured to receive data from the control system, and calculate a parameter related to the performance of the control system.

Other features and advantages of the present invention will become apparent to those skilled in the art from the following detailed description and accompanying drawings. It should be understood, however, that the detailed description and specific examples, while indicating preferred embodiments of the present invention, are given by way of illustration and not limitation. Many modifications and changes within the scope of the present invention may be made without departing from the spirit thereof, and the invention includes all such modifications.

BRIEF DESCRIPTION OF THE DRAWINGS

The exemplary embodiments will hereafter be described with reference to the accompanying drawings, wherein like numerals depict like elements, and.

DETAILED DESCRIPTION

In the following description, for the purposes of explanation, numerous details are set forth in order to provide a thorough understanding of the present invention. It will be evident to one skilled in the art, however, that the exemplary embodiments may be practiced without these specific details. In other instances, structures and device are shown in diagram form in order to facilitate description of the exemplary embodiments. Furthermore, while the exemplary embodiments are often described in the context of HVAC control system utilizing proportional plus integral (PI) action controllers, it should be understood that the disclosed method of and apparatus for evaluating the performance of a control system may be used in any of a variety of control systems and control methodologies.

Figure 1:
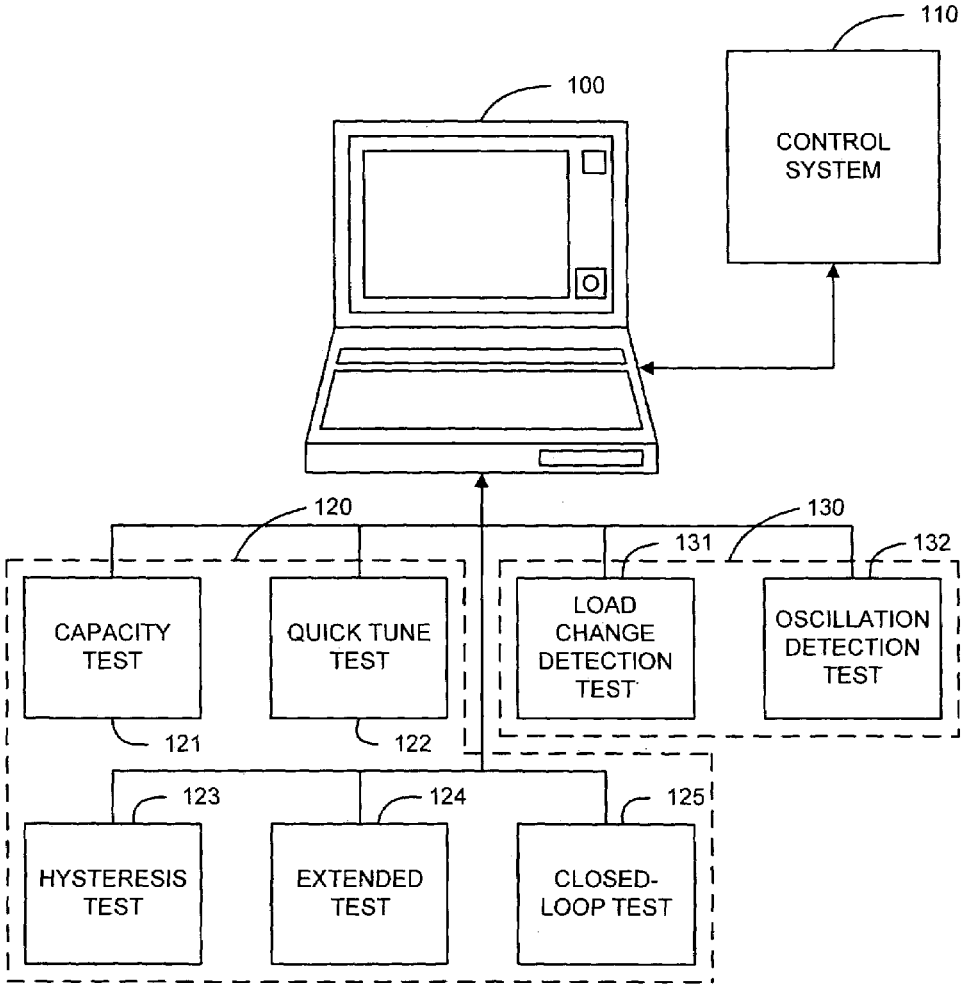
FIG. 1 is a diagram which illustrates an apparatus for assessing control system performance according to an exemplary embodiment.

FIG. 1 illustrates a testing tool 100 for commissioning a control loop according to an exemplary embodiment. Testing tool 100 may be any type of microprocessor-based device with sufficient memory and processing capability. For example, testing tool 100 may be implemented on a desktop or other computer (e.g., a stand-alone system or a networked system of computers), or on a portable device (e.g., laptop computer, personal digital assistant (PDA), etc.). For example, in the illustrated embodiment, testing tool 100 is implemented on a laptop computer which may be made available to field service personnel. Testing tool 100 is configured to be coupled to a control system 110, and may include one or more testing functions (e.g., automated testing functions) in the form of one or more "invasive" testing functions 120 and/or one or more "non-invasive" testing functions 130. The term "invasive" as used herein refers generally to an active testing function, such as a testing function in which a step change to the input, such as a setpoint change, is used in order to assess the response of a feedback control loop within control system 110. The term "non-invasive" generally refers to a passive testing function, such as a testing function that does not require a step change to the input in order to assess the response of the feedback control loop. Testing tool 100 may generally be used to evaluate the performance of a control system. More specifically, testing tool 100 may be used to evaluate the performance of a control loop in an HVAC system using a series of tests, such as automated standardized tests.

Control system 110 may be a control system, such as an HVAC system, which may include one or more industrial controllers utilizing any of a variety of control methodologies. For example, in one embodiment the control methodology may be a proportional plus integral (PI) methodology, and control system 110 may include one or more digital PI controllers operating in discrete time which implement one or more feedback control loops. In other embodiments, control system 110 may include other types of control systems and methodologies.

Figure 2:
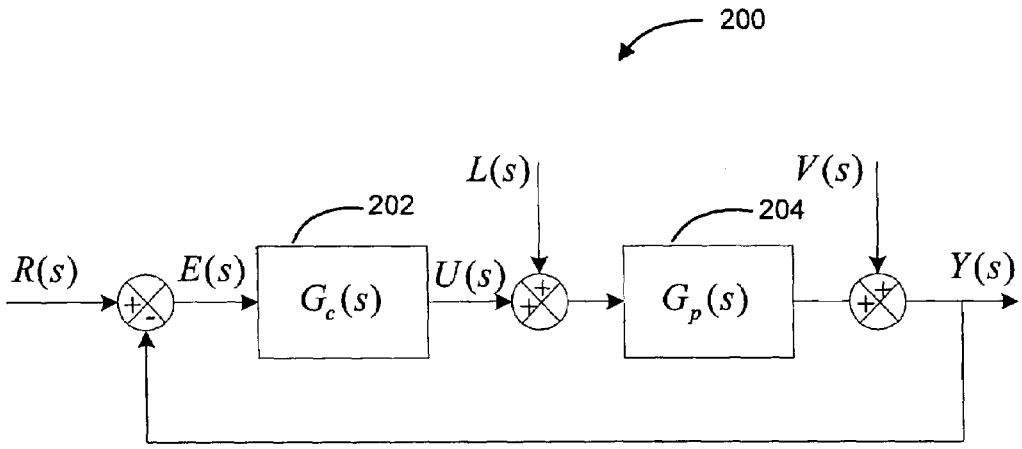
FIG. 2 is a diagram which illustrates a feedback control loop which may be tested using the apparatus of FIG. 1 according to an exemplary embodiment.

FIG. 2 illustrates a typical feedback control loop 200 in control system 110 which may be tested using testing tool 100 according to an exemplary embodiment. Feedback control loop 200 includes a controller 202 and a plant 204, wherein plant 204 represents a device or system to be controlled by feedback control loop 200. In FIG. 2, s denotes the Laplace operator, $G_c(s)$ is the transfer function for the controller and $G_p(s)$ is the plant transfer function. R(s) is the input command or setpoint signal, E(s) is the error signal, U(s) is the controller output, L(s) is a disturbance signal acting at the plant input, V(s) is a disturbance signal acting on plant output, and Y(s) is the feedback signal. Preferably, feedback control loop 200 is designed so that error signal E(s) reaches zero at steady state. In one embodiment, feedback control loop is a PI feedback control loop and the controller transfer function is given by:

$$G_c(s) = \frac{U(s)}{E(s)} = K_c\left(1 + \frac{1}{T_i s}\right) \tag{1}$$

where $K_c$ is the controller gain and $T_i$ is the integral time.

Invasive Testing Functions

Referring again to FIG. 1, invasive testing functions 120 are configured to commission a feedback control loop 200 in control system 110 by inputting a sequence of one or more step changes and observing the response of feedback control loop 200 to each step change. In the illustrated embodiment, invasive testing functions 120 include capacity test 121, quick tune test 122, hysteresis test 123, extended test 124, and closed-loop test 125. Each of these tests may be applied to control system 110 in order to ascertain the degree to which feedback control loop 200 may be controlled, and to characterize the its performance. Additionally, extended test 124 may include a function that characterizes static non-linearity in feedback control loop 200 and outputs a mathematical function that can be added to controller 202 that will cancel the non-linearity.

Invasive testing functions 120 include both open-loop testing functions and closed-loop testing functions. Capacity test 121, quick tune test 122, hysteresis test 123, and extended test 124 are open-loop tests. In these tests, controller 202 is effectively removed from feedback control loop 200 (e.g., by a manual override function) and a step change sequence is applied to U(s). In this way, the performance of plant 204 being controlled by feedback control loop 200 may be evaluated by observing the response to a step change to U(s) without the effects of controller 202. Thus, the focus of capacity test 121, quick tune test 122, hysteresis test 123, and extended test 124 is on the performance of plant 204 rather than controller 202.

Closed-loop test 125 is a closed-loop testing function. In this test, controller 202 remains in feedback control loop 200 such that the performance of plant 204 as well as the performance of controller 202 may be evaluated by observing the response to a step change sequence applied to input command or setpoint signal R(s). Thus, the focus of closed-loop test 125 is on both the performance of plant 204 and the performance of controller 202.

The various invasive testing functions 120 serve different purposes in assessing the performance of a feedback control loop. For example, the purpose of capacity test 121 is to estimate the gain or capacity of plant 204. Quick tune test 122 is similar to capacity test 121, but the emphasis is placed on finding a set of tuning parameters for controller 202 instead of accurately estimating the capacity. Quick tune test 122 is particularly useful for tuning systems with static nonlinearities such as non-uniform gain over the input range of U(s). Hysteresis test 123 is designed to characterize the amount of "play" or "slack" in a particular device controlled by feedback control loop 200 (e.g., a valve). Hysteresis is a form of nonlinearity where the manipulated device does not change position due to slack when a small change of U(s) is applied to it. Extended test 124 is designed to characterize the static nonlinearity of plant 204. Presence of static nonlinearity can make feedback control loop 200 very difficult to control. Typical examples of this behavior are oversized valves that have a high gain at one end of the range of U(s). By characterizing the nonlinear characteristics of the valve, the effects of nonlinearity may be reduced to maintain satisfactory control. Closed-loop test 125 is designed to characterize the performance of controller 202 where plant 204 exhibits dynamic nonlinearity. Dynamic nonlinearity exists where the dynamics of plant 204 change when U(s) changes direction.

Figure 3:
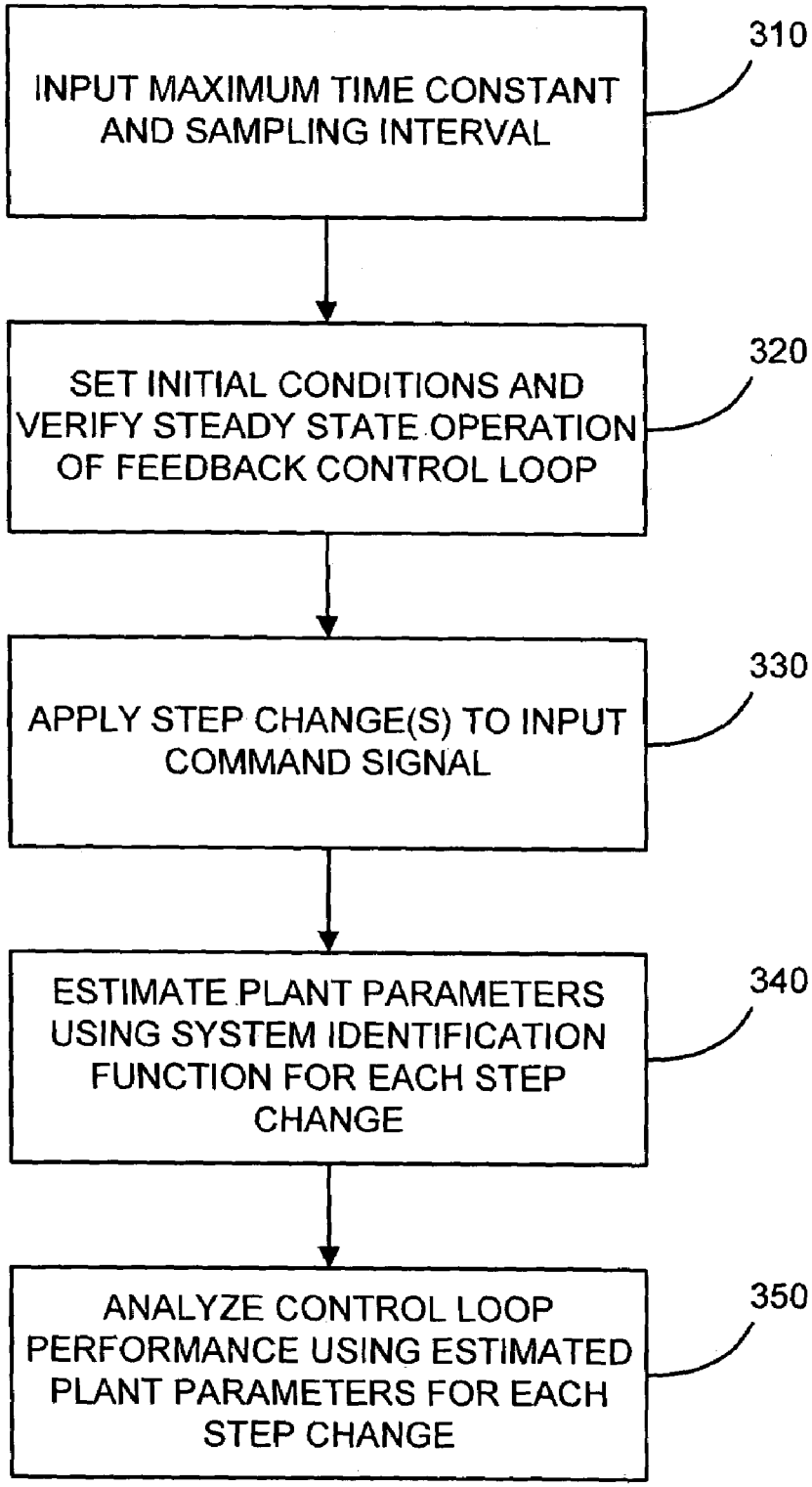
FIG. 3 is a flow diagram which illustrates a general process for performing invasive testing functions the feedback control loop of FIG. 2 according to an exemplary embodiment.

FIG. 3 illustrates a general process for performing invasive testing functions 120 on feedback control loop 200. The process begins with step 310. In step 310, a user may input two parameters: the maximum time constant $\tau$ and the sampling interval $\Delta t$. Preferably, the maximum time constant $\tau$ contains some information about plant 204 in feedback control loop 200, and the sampling interval $\Delta t$ is set to be as small as possible. Alternatively, where an unidentified system is being tested, the maximum time constant $\tau$ may be set to an arbitrary large value and the sample interval $\Delta t$ may be set to an arbitrary small value. In this situation, the specified maximum time constant $\tau$ may be many times the actual time constant of plant 204.

According to an exemplary embodiment, testing tool 100 may include a time-out feature so that a particular test will fail if no parameter convergence has occurred within a period of five times the specified value of maximum time constant $\tau$. Accordingly, in this embodiment, where an arbitrarily large value of maximum time constant $\tau$ is specified for an unidentified system, a user may supervise or intervene with the test to ensure that an excessively long period does not elapse before time-out. While there is no theoretical lower bound on the sample interval $\Delta t$, the sampling interval is preferably smaller than half the expected time delay or smaller that half the maximum time constant $\tau$, which ever yields the smallest interval.

In step 320, feedback control loop 200 is reset to the initial testing conditions and steady state operation of feedback control loop 200 under the initial testing conditions is verified. The initial testing conditions for each invasive testing function 120 will be discussed with reference to FIGS. 4–8 below. Verification of steady state operation at the initial testing conditions is performed, e.g., by the user, in order to ensure the accuracy of the test results, as transient conditions at the start of a test may lead to deteriorated accuracy or test failure.

In step 330, an input sequence of one or more step changes is applied to the feedback control loop 200. The step change sequence is applied to U(s) for all open-loop tests and to input command signal or setpoint R(s) for closed-loop test 125. FIGS. 4–8 illustrate the various step change sequences that may be used for each invasive testing function 120 according to an exemplary embodiment.

Figure 4:
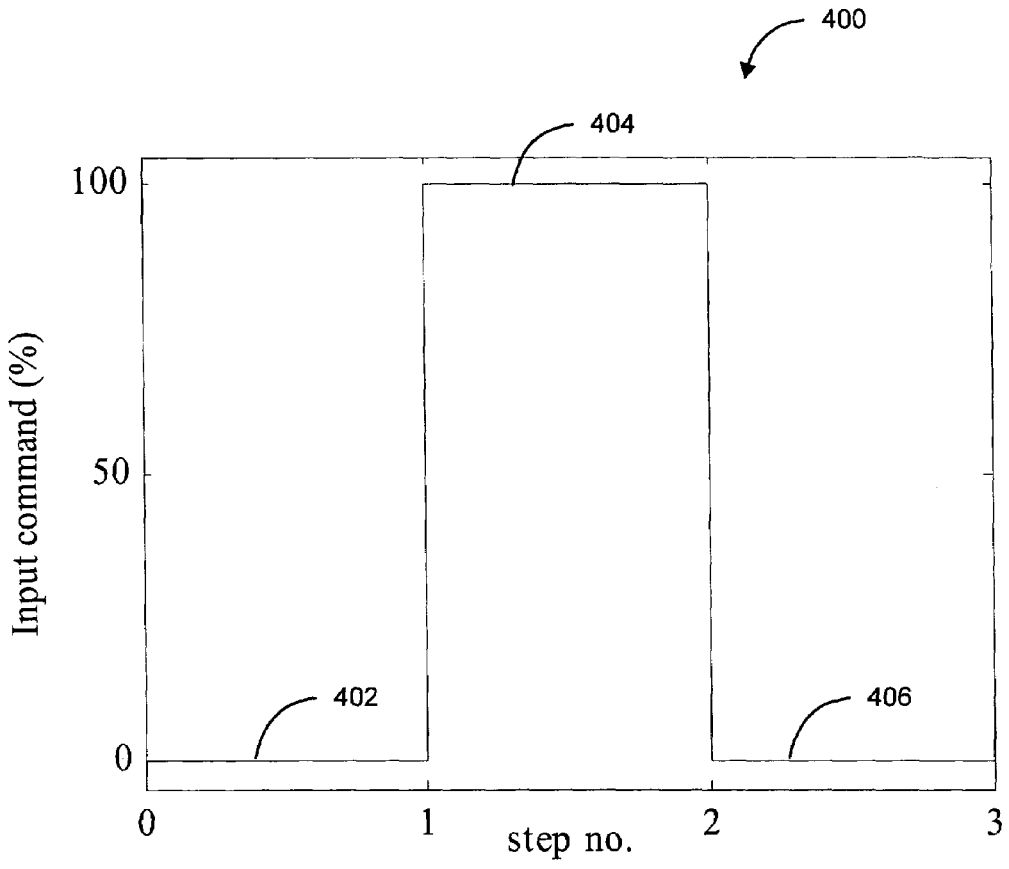
FIG. 4 is a diagram which graphically illustrates a step change sequence for the capacity test according to an exemplary embodiment.

FIG. 4 illustrates a step change sequence 400 for capacity test 121 according to an exemplary embodiment. In capacity test 121, feedback control loop 200 is placed under open-loop conditions and then step change sequence 400 is applied to U(s). As shown by segment 402 of step change sequence 400, U(s) is set to an initial testing condition of 0 percent of the maximum input range of U(s) before starting the test in step 320, and the system is allowed to reach steady state operation. Then U(s) is stepped up to 100 percent as shown by segment 404 of step change sequence 400, and gain, time constant, and time delay parameters are estimated for plant 204, as will be described below with regard to step 340. U(s) is then returned to 0 percent, as shown by segment 406 of step change sequence 400, and the gain, time constant, and time delay parameters are again estimated for plant 204. Because of system nonlinearities, the gain of plant 204 may vary for the step up and the step down. For this reason, capacity test 121 performs two steps (i.e., the 0 percent–100 percent and 100 percent–0 percent step changes) in order to characterize the parameters of plant 204 for the different directions of the change in U(s).

Figure 5:
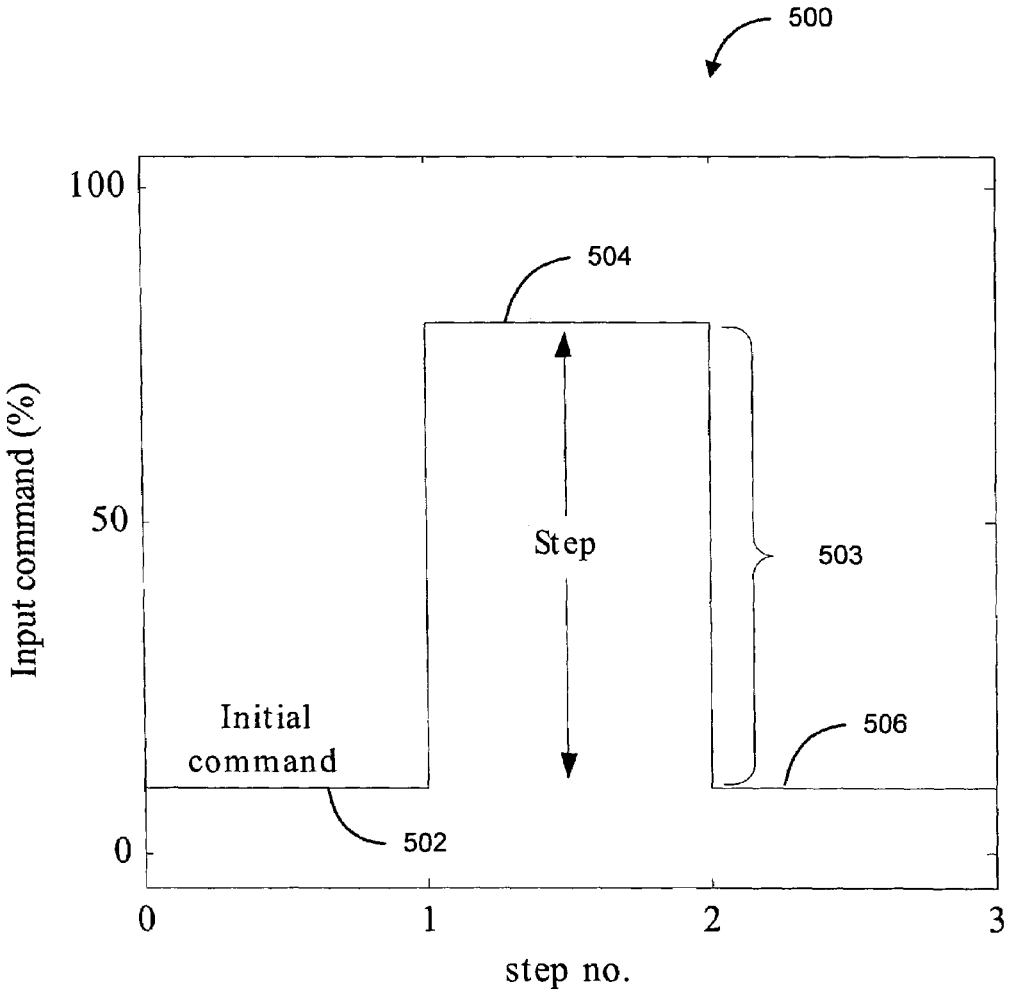
FIG. 5 is a diagram which graphically illustrates a step change sequence for the quick tune test according to an exemplary embodiment.

FIG. 5 illustrates a step change sequence 500 for quick tune test 122 according to an exemplary embodiment. In quick tune test 122, feedback control loop 200 is placed under open-loop conditions and then step change sequence 500 is applied to U(s). For quick tune test 122, the user may start the test at any desired initial steady state testing condition 502 and select any step size 503. This selection of input step size 503 is the main difference between capacity test 121 and quick tune test 122. The quick tune test allows the user to perform the steps in any part of the range of U(s). This flexibility is particularly useful for tuning systems with static nonlinearities such as non-uniform gain over the input range of U(s). For example, the user may perform the steps from approximately 0 percent–30 percent and 30 percent-0 percent if plant 204 is nonlinear and exhibits high gain in the lower range of U(s). As with capacity test 121, two steps 504 and 506 are performed in order to characterize plant 204 for both directions of the change in U(s), and the gain, time constant, and time delay parameters are estimated for plant 204 for each step change in step change sequence 500.

Figure 6:
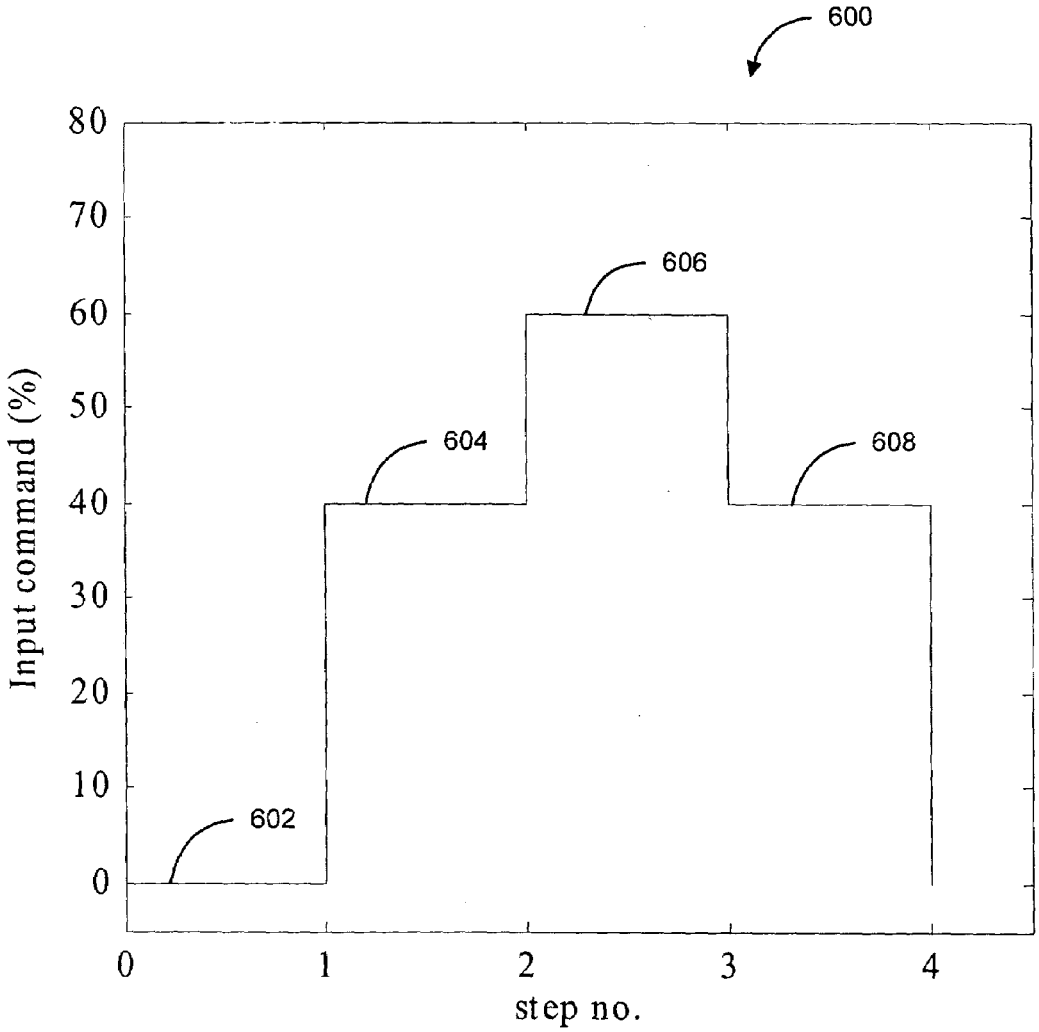
FIG. 6 is a diagram which graphically illustrates a step change sequence for the hysteresis test according to an exemplary embodiment.

FIG. 6 illustrates a step change sequence 600 for hysteresis test 123 according to an exemplary embodiment. In hysteresis test 123, feedback control loop 200 is placed under open-loop conditions and then step change sequence 600 is applied to U(s). As stated above, hysteresis is a form of nonlinearity where the manipulated device does not change position due to slack when a small change of U(s) is applied to it. This situation usually occurs when U(s) reverses direction. As shown by segment 602 of step change sequence 600, U(s) is set to an initial testing condition of 0 percent of the maximum range of U(s) before starting the test in step 320, and the system is allowed to reach steady state operation. U(s) is then increased to 40 percent so that any previous play in the system is removed in the forward direction and all the play is observed when the direction of U(s) is reversed. The maximum amount of slack is assumed to occur at the middle of the input signal range (i.e., at 50 percent of U(s)). Accordingly, in the illustrated embodiment, U(s) is changed from approximately 40 percent, as shown by segment 604, to approximately 60 percent, as shown by segment 606, and then back again to approximately 40 percent, as shown by segment 608, to capture the maximum play in the system. The gain of plant 204 for step changes two and three corresponding to segments 606 and 608 is then calculated in step 340.

Figure 7:
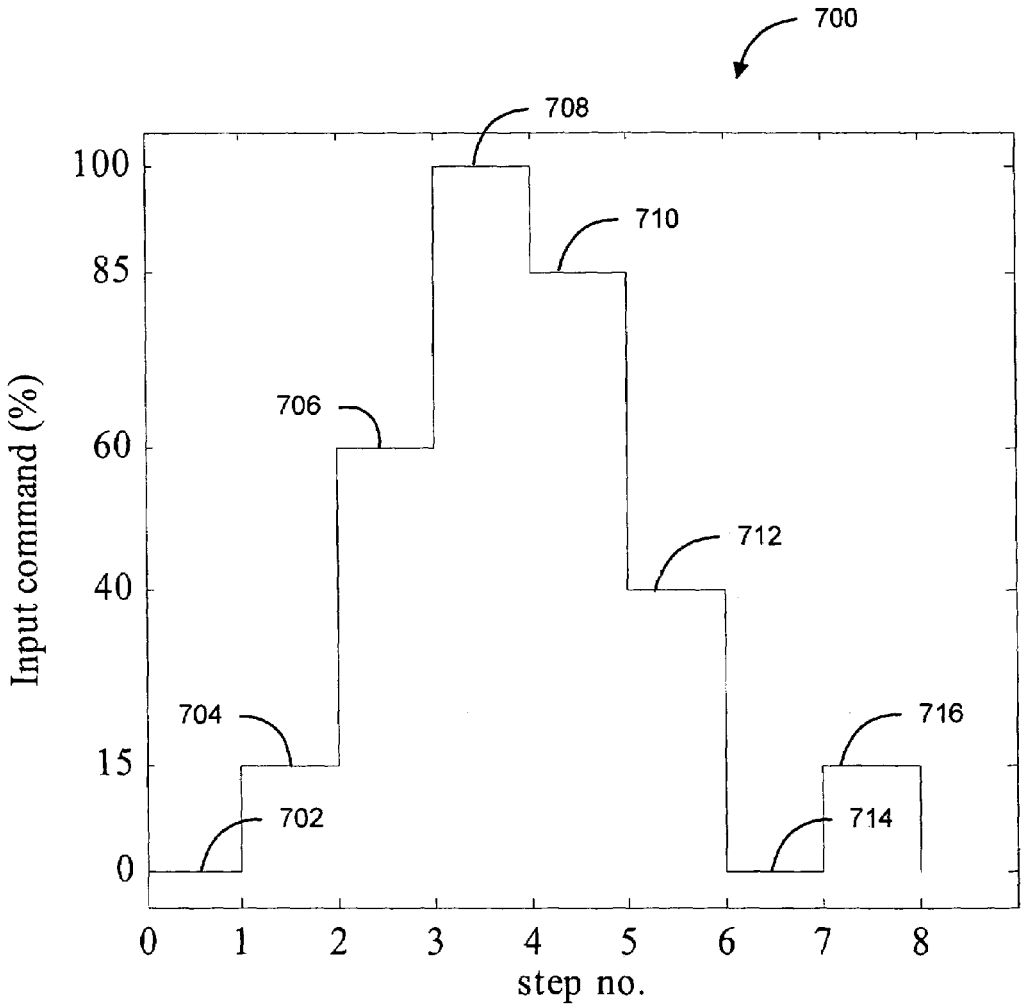
FIG. 7 is a diagram which graphically illustrates a step change sequence for the extended test according to an exemplary embodiment.

FIG. 7 illustrates a step change sequence 700 for extended test 124 according to an exemplary embodiment. In extended test 124, feedback control loop 200 is placed under open-loop conditions and then step change sequence 700 is applied to U(s). As stated above, extended test 124 is designed to characterize the static nonlinearity of plant 204. In order to characterize the static nonlinearity, step change sequence 700 includes a sequence of small steps throughout the range of U(s). As shown by segment 702 in the illustrated embodiment, U(s) is set to an initial testing condition of 0 percent of the maximum range of U(s) before starting the test in step 320, and the system is allowed to reach steady state operation. U(s) is then increased to 100 percent through a sequence of small steps, and is returned to 0 percent through a series of small steps. For example, in the illustrated embodiment, the step sequence for the input signal is 15 percent as shown by segment 704, 60 percent as shown by segment 706, 100 percent as shown by segment 708, 85 percent as shown by segment 710, 40 percent as shown by segment 712, and then 0 percent as shown by segment 714. The gain, time constant, and time delay parameters are estimated for plant 204 for each step change in step change sequence 700 in step 340.

Because the system identification function in step 340 may be sensitive to the system being in steady-state before starting the test, the gain, time constant, and time delay parameters estimated for plant 204 from the first step from 0 to 15 percent may not be accurate. Accordingly, in the illustrated embodiment, the estimated parameters from the first step are discarded and another 15 percent step is performed after the input is returned to zero, as shown by segment 716, followed by a return to zero after this step.

Through the series of small steps, extended test 121 can characterize the input-output relation for plant 204 for the entire range of U(s). This information can then be used for designing strategies to achieve better control. For example, one such strategy is to cancel the static nonlinearity by modifying U(s) using the identified input-output relation as will be described below with regard to step 350.

Figure 8:
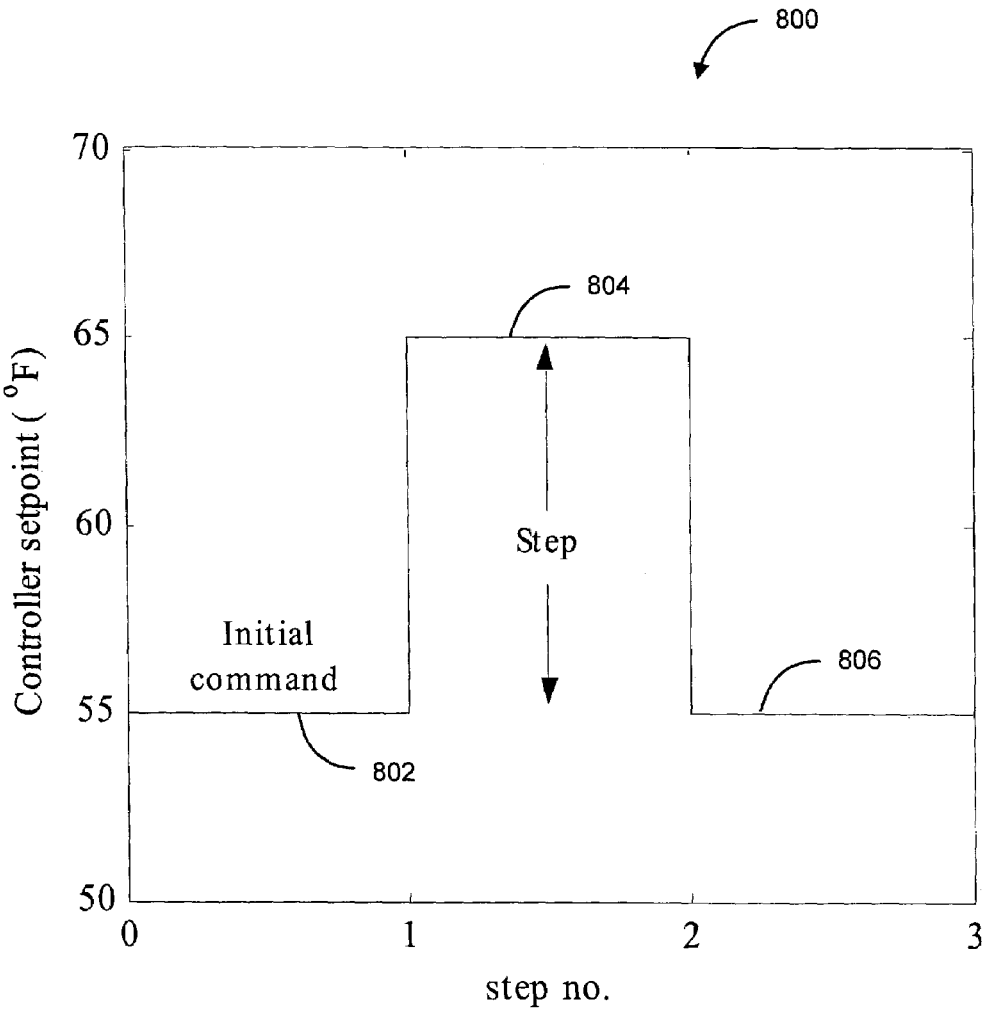
FIG. 8 is a diagram which graphically illustrates a step change sequence for the closed-loop test according to an exemplary embodiment.

FIG. 8 illustrates a step change sequence 800 for closed-loop test 125 according to an exemplary embodiment. The closed-loop test is performed to characterize the performance of controller 202. In closed-loop test 125, step change sequence 800 is applied to setpoint signal R(s) in order to perform a sequence of two step changes to the controller setpoint. For example, in the illustrated embodiment, which represents a setpoint step sequence for the closed-loop test of a cooling coil discharge air temperature, setpoint signal R(s) is set to an initial setpoint of approximately 55 degrees Fahrenheit in step 320, as shown by segment 802, and the system is allowed to reach steady state operation. Then setpoint signal R(s) is stepped up to a setpoint of approximately 65 degrees Fahrenheit as shown by segment 804, and then returned to a setpoint of approximately 55 degrees Fahrenheit, as shown by segment 806. The gain, time constant, and time delay parameters are estimated for plant 204 in step 340 for each setpoint change. The steps up and down of the controller setpoint may be used to assess the performance of controller 202 if the system exhibits dynamic nonlinearity, i.e., the system dynamics change when setpoint signal R(s) changes direction. For example, controller 202 may be aggressive for the step up, but may produce a sluggish response for the step down. Closed-loop test 125 attempts to characterize the performance of controller 202 for both situations.

Referring again to FIG. 3, at step 340, a system identification function is used to characterize plant 204 in feedback control loop 200 by estimating several parameters. For example, in one exemplary embodiment, the system identification function may be used to estimate the gain, time constant, and time delay parameters for plant 204 for each step change to R(s) in step 330.

According to an exemplary embodiment, the system identification function includes an algorithm that is used to estimate the parameters in a first-order plus time delay (FOPTD) model. The parameter estimation algorithm directly estimates parameters in a continuous time transfer function model via substitution of the s operator. The s operator is redefined in terms of a first-order low-pass filter given by:

$$H(s) = \frac{1}{1+\tau s} \tag{2}$$

The s operator is then:

$$s = \frac{1}{\tau}\left(\frac{1}{H(s)} - 1\right) \tag{3}$$

The definition of the s operator given in Eq. (3) may then be substituted into a transfer function of interest. In the parameter estimation algorithm, a second-order model is used to represent plant 204, i.e.:

$$G(s) = \frac{Y(s)}{U(s)} = \frac{b}{s^2 + a_1 s + a_2} \tag{4}$$

The H(s) operator is substituted for the s operator in the second order model, which yields:

$$\frac{Y(s)}{U(s)} = \frac{\beta H(s)H(s)}{1 + \alpha_1 H(s) + \alpha_2 H(s)H(s)} \tag{5}$$

Accordingly, in the s-domain, the output Y(s) is given by:

$$Y(s) = -\alpha_1[Y(s)H(s)] - \alpha_1[Y(s)H(s)H(s)] + \beta_1[U(s)H(s)H(s)] \tag{6}$$

A transformation into the time domain gives the following input-output model:

$$y(t) = -\alpha_1 y^{f1}(t) - \alpha_1 y^{f2}(t) + \beta_1 u^{f2}(t) \tag{7}$$

where $$u^{fN}(t) = L^{-1}\left(U(s)\prod_{i=1}^{N} H(s)\right) \text{ and likewise,} \tag{8}$$

$$y^{fN}(t) = L^{-1}\left(Y(s)\prod_{i=1}^{N} H(s)\right) \tag{9}$$

where $L^{-1}$ is the inverse Laplace transform. The filtered inputs and outputs are realizable by using discrete form low-pass filters operating in series.

There is a linear transformation between the parameters $\alpha_1, \ldots \alpha_n, \beta_1 \ldots \beta_n$ and the original transfer function parameters $a_1, \ldots \alpha_n, \ldots b_1 \ldots b_n$ when the time constant in the low-pass filters is greater than zero. In general terms, this transformation is given by:

$$\theta_r = F\theta + G \tag{10}$$

where $\theta^T = [-\alpha_1 \ldots -\alpha_n\ b_1 \ldots b_n]$ is the parameter vector containing the transfer function parameters. F and G are given by:

$$F = \begin{bmatrix} M & 0 \\ 0 & M \end{bmatrix} \tag{11}$$

with $$M = \begin{bmatrix} m_{11} & 0 & 0 \\ \vdots & \ddots & 0 \\ m_{n1} & \ldots & m_{nn} \end{bmatrix};\quad m_{ij} = (-1)^{i-j}\binom{n-j}{i-j}\tau^j \tag{12}$$

and $$G = [g_1 \ldots g_n\ 0 \ldots 0];\quad g_i = \binom{n}{i}(-1)^i \tag{13}$$

The matrix F is invertible when M is invertible, which occurs for all $\tau > 0$. Because of the linear relationship between parameters, the parameters in the original transfer function can be estimated directly from input-output data using a recursive least-squares algorithm.

Figure 9:
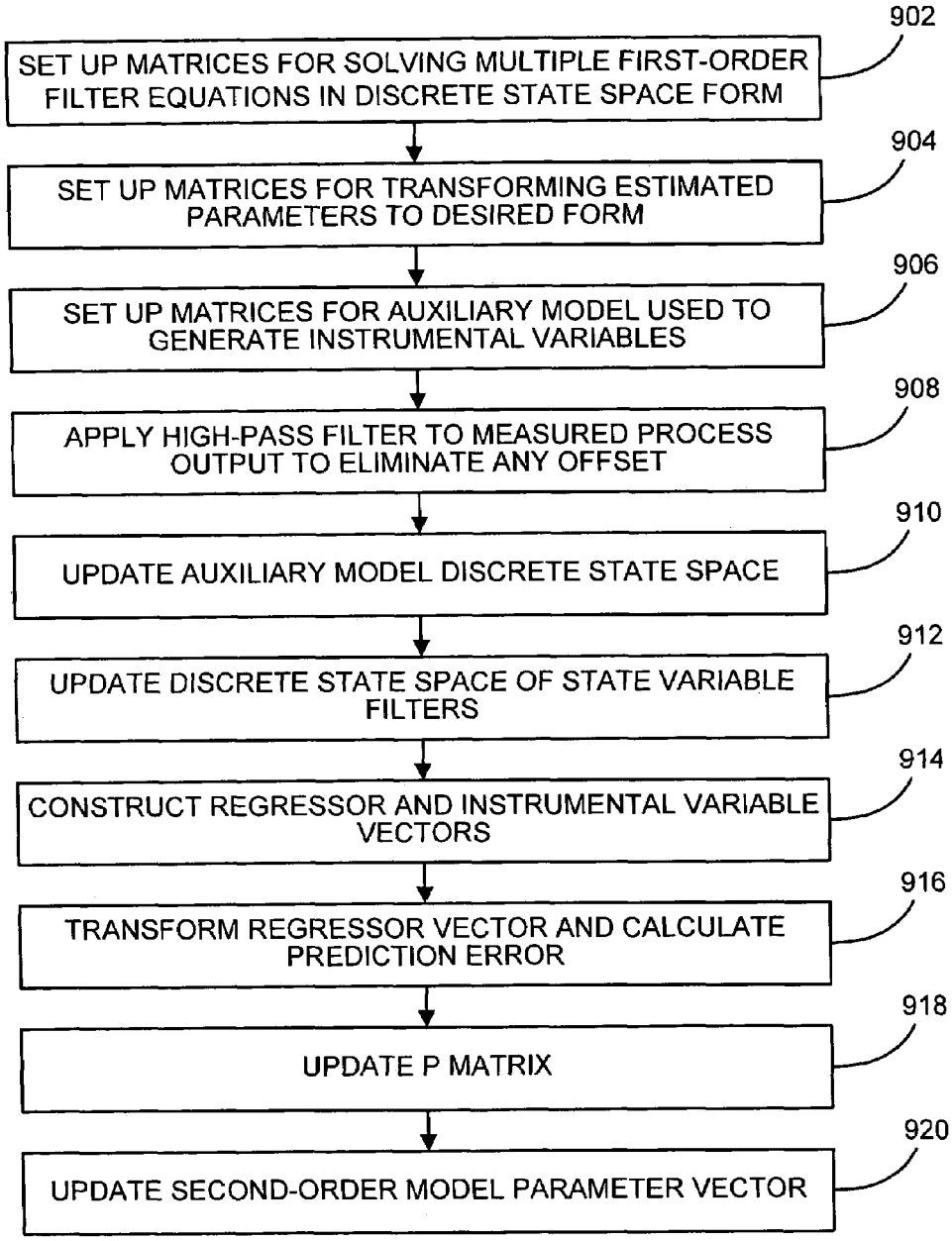
FIG. 9 is a flow diagram which illustrates a parameter estimation algorithm according to an exemplary embodiment.

FIG. 9 diagrammatically illustrates a parameter estimation algorithm according to an exemplary embodiment. At step 902, matrices are set up for solving multiple first order filter equations in discrete state-space form according to:

$$A = \begin{bmatrix} a_{11} & 0 & 0 \\ \vdots & \ddots & 0 \\ a_{n1} & \ldots & a_{nn} \end{bmatrix};\quad a_{ij} = \gamma(1-\gamma)^{i-j} \tag{14}$$

$$B = [b_1 \ldots b_n];\ b_i = (1-\gamma)^i \tag{15}$$

At step 904, matrices are set up for transforming estimated parameters to desired form according to:

$$M = \begin{bmatrix} m_{11} & 0 & 0 \\ \vdots & \ddots & 0 \\ m_{n1} & \ldots & m_{nn} \end{bmatrix};\quad m_{ij} = (-1)^{i-j}\binom{n-j}{i-j}\tau^j \tag{16}$$

$$F = \begin{bmatrix} M & 0 \\ 0 & M \end{bmatrix} \tag{17}$$

$$G = [g_1 \ldots g_n\ 0 \ldots 0];\quad g_i = \binom{n}{i}(-1)^i \tag{18}$$

At step 906, matrices are set up for auxiliary model used to generate instrumental variables according to:

$$C = \begin{bmatrix} \rho_1 & 0 & 0 \\ \{\rho_1(1-\rho_2)\} & \rho_2 & 0 \\ \gamma\{\rho_1(1-\rho_2)\} & \gamma(\rho_2 - 1) & \gamma \end{bmatrix}; \tag{19}$$

$$d = [(1-\rho_1)\quad \{(1-\rho_1)(1-\rho_2)\}\quad \gamma\{(1-\rho_1)(1-\rho_2)\}]$$

At step 908, a high-pass filter is applied to measured process output to eliminate any offset according to:

$$y_k^{hp} = \gamma(y_{k-1}^{hp}) + \gamma[y_k - y_{k-1}] \tag{20}$$

At step 910, auxiliary model discrete state space (in closed-loop r is used instead of u) is updated according to:

$$\hat{x}_{k+1}=C\hat{x}_k+du_k;\hat{x}=[\hat{x}_1\hat{x}_2\hat{x}_3] \tag{21}$$

At step 912, discrete state space of state variable filters is updated according to:

$$u_{k+1}^f+=Au_k^f+Bu_k$$

$$y_{k+1}^f=Ay_k^f+By_k^{hp}$$

$$\hat{x}_{k+1}^f=A\hat{x}_k^f+B\hat{x}_{2,k}^{hp} \tag{22}$$

At step 914, regressor and instrumental variable vectors are constructed according to:

$$\phi_k^T=[(y^{hp})_k^{f1}(y^{hp})_k^{f2}\{u_k^{f2}-u_k^{f3}\}] \tag{23}$$

$$\eta_k^T=[\hat{x}_{3,k}^{f1}\hat{x}_{3,k}^{f2}\{u_k^{f2}-u_k^{f3}\}] \tag{24}$$

At step 916, the regressor vector is transformed and a prediction error (e) is calculated according to:

$$\psi_i=F^T\phi_i;$$

$$e_k=y_k^{hp}-(\theta_{k-1}^T\psi_k+G^T\phi_k \tag{25}$$

At step 918, the P matrix is updated according to:

$$P_k = P_{k-1} - \frac{P_{k-1}\eta_k\psi_k^T P_{k-1}}{1+\psi_k^T P_{k-1}\eta_k} \tag{26}$$

At step 920, the second-order model parameter vector is updated according to:

$$\hat{\theta}_k=\hat{\theta}_{k-1}+P_k\eta_k e_k;\ \text{where } \theta^T=[-\alpha_1-\alpha_2 b_1] \tag{27}$$

where $\gamma=\exp(-\Delta t/\tau)$ and $\rho_1=\exp(-\Delta t/\tau)$ and $\rho_2=\exp(-\Delta t/\tau_2)$. The time constants $\tau_1$ and $\tau_2$ are set so that $\tau_1=\tau/2$ and $\tau_2=\tau/2$. The parameter estimation algorithm thus only requires the user to set the initial filter time constant $\tau$. The $\tau$ value must be set to be greater than the anticipated time constant of plant 204. As discussed above, the value may be set to a large arbitrary initial value if no prior information about plant 204 is available. The parameter estimation algorithm can deal with variable sampling intervals since all parameters relate to continuous time model formulations.

The parameter estimation algorithm described above allows estimation of the parameters in a second order model from input-output measurements. An additional transformation is thus needed to obtain the parameters in a FOPTD model. The steady-state gain of plant 204 may be evaluated directly from the second order parameters by setting s to zero in Eq. (4). The steady state gain is accordingly given by:

$$\hat{K} = \frac{b_1}{a_2} \tag{28}$$

Estimation of the time delay (L) and time constant (T) for plant 204 is achieved by fitting the FOPTD model to the second order model in the frequency domain so that the two models intersect at a phase lag of $-\pi/2$. This methodology provides an estimate of original the time delay and time constant for plant 204 with the second-order model acting as the intermediary model in the procedure. The time constant estimate is:

$$\hat{T} = \sqrt{\frac{a_1^2}{a_2^2} - \frac{1}{a_2}} \tag{29}$$

The time delay estimate is:

$$\hat{L} = \frac{-\tan^{-1}(-\hat{T}\sqrt{a_2}) - \pi/2}{-\sqrt{a_2}} \tag{30}$$

The time constant and time delay will be indeterminate when:

$$\frac{a_1^2}{a_2} < 1 \tag{31}$$

Equating the characteristic equation of the second-order model to the standard second-order characteristic equation as defined by $Q(s)=s^2+2\xi\omega_N+\omega^2N$, T and L become indeterminate when the damping factor $\xi$ is less than 1/16. It is possible that such an underdamped plant may be identified if the data were corrupted by unmeasured disturbances. According to one embodiment, in order to extract L and T values for the case when the constraint in Eq. (31) is violated, an alternative procedure may be used. The alternative procedure is based on the geometry of the time domain response to a step change of the second-order model. First, the time constant is evaluated as the inverse of the maximum gradient of the response according to:

$$\hat{T} = \frac{1}{\omega_N}e^{\frac{\phi}{f}} \tag{32}$$

$$\phi = \tan^{-1}(f)$$

$$f = \frac{\sqrt{1-\xi^2}}{\xi}$$

The response is given by:

$$y(t) = 1 - \frac{1}{\sqrt{1-\xi^2}}e^{-\xi\omega_N t}\sin(\omega_N t\sqrt{1-\xi^2} + \phi). \tag{33}$$

The time delay for plant 204 is then evaluated based on the point where the tangent to the point of maximum slope on the response intersects the y-axis, hence:

$$\hat{L}=t_m-\hat{T}y(t_m) \tag{34}$$

where $$t_m = \frac{\phi}{\omega_N\sqrt{1-\xi^2}}, \tag{35}$$

is the time of maximum slope

The static gain estimate obtained from the intermediary second order model is used to detect parameter convergence. The second order model is of the form:

$$G(s) = \frac{b}{s^2 + a_1 s + a_2} \tag{36}$$

The static gain estimate at sample i is obtained from estimates of the second order model parameters as follows:

$$\hat{K}_i = \frac{\hat{b}_i}{\hat{a}_{2,i}} \tag{37}$$

The gain estimate varies according to the following relation when new information is being obtained during a test:

$$\left|\frac{\hat{K}_i - \hat{K}_{i-1}}{\hat{K}_{i-1}}\right| = 1 - e^{\frac{-\Delta t}{\alpha}} \tag{38}$$

In Eq. (38) $\alpha$ may tend to vary monotonically with time, beginning at a value smaller than the overall plant time constant and becoming larger than the plant time constant as a convergent condition evolves. Accordingly, a normalized convergence index c may be calculated from the state variable filter time constant $\tau$ which also relates to an estimate of the maximum time constant of plant 204. The normalized convergence index c is given by:

$$c = \left|\frac{\hat{K}_i - \hat{K}_{i-1}}{\hat{K}_{i-1}\left(1 - e^{\frac{-\Delta t}{\tau}}\right)}\right| \tag{39}$$

where $c \rightarrow 0$ as convergence progresses. According to an exemplary embodiment, a convergence threshold value of approximately 0.5 may be used to provide satisfactory results across a range of systems. To allow for the effect of noise in the process, convergence is preferably indicated only when a statistically significant number of sequential threshold violations occur. For example, in one embodiment, consideration of approximately thirty samples may provide satisfactory results.

When convergence has occurred, the filter time constant $\tau$ is updated based on the estimated average residence time (given by L+T). According to one embodiment, since, the $\tau$ value has to be greater than the time constant of plant 204, the time constant value may be set to three times the estimated average residence time, i.e., $\tau$=3(L+T).

Referring again to FIG. 3, in step 350, the performance of feedback control loop 200 may be analyzed using the gain, time constant, and time delay parameters for plant 204 determined for each step change in step as determined by the system identification function in step 340. Various analyses may be performed depending on the particular invasive testing function 120 being implemented, and the results of the analysis are provided to the user. According to an exemplary embodiment, the various analyses may include calculation of tuning parameters for controller 202, control loop auditing for control loop 200, hysteresis characterization of plant 204, characterization and cancellation of static linearity in plant 204, and closed-loop response characterization.

Calculation of tuning parameters for controller 202 is performed for each of the non-invasive test functions 120 according to the tuning rule given by:

$$K_c = \frac{0.14}{K_p} + \frac{0.28T}{LK_p} \qquad T_i = 0.33L + \frac{6.8LT}{10L + T} \tag{40}$$

where $K_c$ is the controller gain; $T_i$ is the integral time; and $K_p$, L,T are the gain, time delay, and time constant respectively as determined for plant 204 in step 340. Although the gain, time delay, and time constant for plant 204 are estimated for each test in step 340, use of the values directly in the tuning rule of Eq. (40) would yield parameters for controller 202 that only produce the desired control performance at the specific operating points exercised in the test. Accordingly, in one embodiment, adjustments may be made to the parameter values estimated in step 340 to allow for expected non-linearity, and then the adjusted parameters may be used in the tuning rule. According to an exemplary embodiment, a different adjustment procedure may be used for each of the non-invasive tests 120 as described below.

For example, in capacity test 121, control loop 200 is put in open-loop and input command signal R(s) is stepped from 0 percent to 100 percent and back again to 0 percent. Most of the dynamic non-linearity in HVAC systems, for example, is related to the direction of change in the manipulated variable rather than the magnitude of change. For example, heat exchangers exhibit different dynamics depending on the direction of heat flow between fluids of different heat capacity, i.e., the air leaving a water-to-air heating coil takes longer to cool down than it does to heat up. Capacity test 121 sufficiently characterizes dynamic non-linearity since a step change is performed in both directions. A controller tuned based on specification of L and T values becomes more conservative as T increases but also as X increases, where:

$$\lambda = \frac{L}{L + T} \tag{41}$$

and $0 \leqq \lambda \leqq 1$. The system identification function of step 340 yields more reliable estimates of L+T (average residence time), but less reliable estimates of $\lambda$. Accordingly, in one embodiment, the maximum L+T value may be used in the tuning rule, but an average value of $\lambda$ may be used to reduce the effect of a single unreliable estimate. The values used in the tuning rule for the delay, $L_R$, and time constant, $T_R$ are thus calculated from the following:

$$L_R = \bar{\lambda}_w \max(L+T)$$

$$T_R = \max(L+T) - L_R \tag{42}$$

where $\bar{\lambda}_w$ is a weighted average that is calculated according to the weighted averaging procedure described below. Static non-linearity is not well characterized by capacity test 121 and any estimate of gain that is obtained from a 0 percent–100 percent step test may be lower than the gain exhibited in a low-load part of the range. Calculation of parameters for controller 202 from the 0 percent–100 percent gain estimate would therefore lead to overly aggressive or oscillatory control action in the high gain regions. Thus, in order to avoid the possibility of oscillatory response, a scaling factor may be introduced so that the gain used in the tuning rule is higher than the gain estimated from capacity test 121. For example, according to an exemplary embodiment, a scaling factor of 4 may yield satisfactory results across a range of different HVAC systems and may be applied to the average of the two gain estimates as follows:

$$K_R=4\overline{K}_w \tag{43}$$

where $\overline{K}_w$ is a weighted average of the two gain estimates. If only one step is successful in capacity test 121, then $L_R=L$, $T_R=T$, and $K_R=4K$ are used in the tuning rule.

In quick tune test 122, the analysis assumes that the initial testing condition and step size are selected by the user to reflect where plant 204 will normally be operated. Quick tune test 122 may thus produce better estimates of the static gain for plant 204 than is possible in capacity test 121. Accordingly, a methodology similar to that employed in capacity test 121 may be used to determine the parameters for the tuning rule but with a less conservative scaling factor for the gain, i.e., $$L_R=\overline{\lambda}_w \max(L+T)$$

$$T_R=\max(L+T)-L_R$$

$$K_R=2\overline{K}_w \tag{44}$$

where the subscript w denotes weighted averages. According to an exemplary embodiment, a scaling factor of 2 may used for the plant gain estimate to provide satisfactory results for different systems. A smaller gain scaling factor may be chosen for quick tune test 122 than for capacity test 121 because the estimated gain from quick tune test 122 is more likely to be representative of the high gain operating region of plant 204.

In extended test 124, the FOPTD model parameters are estimated for each of several small steps across the range of input command signal R(s), thereby revealing both static and dynamic non-linearities. Accordingly, the highest static gain value established from the tests may be used directly in the tuning rule of Eq. (40) without applying a scaling factor. For the dynamic parameters, the same procedure is employed as in capacity test 121 and quick tune test 122, whereby the average λ value is combined with the largest residence time estimate. The tuning parameters are thus calculated as follows:

$$L_R=\overline{\lambda} \max(L+T)$$

$$T_R=\max(L+T)-L_R$$

$$K_R=\max(K) \tag{45}$$

A simple average of λ is used for the results from extended test 124. The procedure above is applied to all successful steps in the extended test 124, and any failed steps in the sequence may be ignored.

In closed-loop test 125, the analysis assumes that the test is performed at or near the normal operating point of the plant, and controller 202 is tuned for the characteristics of plant 204 estimated in step 340 without the use of scaling factors. Additionally, because plant 204 is tested in closed-loop, the tuning of the initial controller will determine to what extent the range of U(s) is explored during each step change. U(s) may change in both directions for each change in setpoint and the static gain non-linearity may manifest itself in different ways in the parameters obtained from each step change. Furthermore, closed-loop plant identification is generally less reliable than open-loop due to lower information content in the signals. Accordingly, averaging of the parameters obtained from each step change is performed to provide the tuning rule inputs, i.e., $$L_R=\overline{L}_w$$

$$T_R=\overline{T}_w$$

$$K_R=\overline{K}_w \tag{46}$$

where weighted averages of all parameters are used in the tuning rule. No scaling factor is applied to the parameters, since it is anticipated that a user would wish to tune controller 202 as best as possible for the setpoints selected in the test. As with capacity test 121, in the case of one failed step change, the parameters from the successful step change are used directly.

In addition to the various adjustment procedures described above, a weighted averaging procedure may also be used in calculating the tuning parameters for controller 202. The algorithm used in step 340 is designed for application to plant 204 when it is in steady state at the beginning of a test. If plant 204 is in a transient condition when the test is started, the parameters estimated for the first step change may be corrupted. The degree of error in the parameters will depend on how far away the initial state vector is from its equilibrium point. The extent of any initial deviation from steady state conditions cannot be established without knowledge of the dynamics of plant 204, which are unknown at the start of a test.

Because the user may misinterpret the initial steady state condition, a lower level of confidence may be attributed to the parameters obtained from the first step change. According to one embodiment, this difference in confidence between step changes may be handled by using weighted averages rather than straight averages in analyzing the data for each step change. This is not a concern for extended test 124 because the parameters estimated for the first step are discarded. All other tests involve carrying out two steps and weighted averages are calculated according to:

$$\overline{\theta}_w=w\theta^T \tag{47}$$

where $\overline{\theta}_w$ is the weighted average of a particular parameter (e.g., static gain), w is the two element weight vector, and $\theta^T=[\theta_1\theta_2]$ is the two element parameter vector. According to an exemplary embodiment, the weight vector is set to $w^T=[1/4\ 3/4]$ so that the first test is only attributed a 25 percent weighting in the calculations.

Control loop auditing may also be performed as part of the analysis in step 350 because in many situations it may not be possible to obtain good results from controller 202 simply by re-tuning it. For example, plant 204 may be inherently difficult to control and not well-suited for controller 202. Accordingly, control loop auditing may be performed in order to establish whether there are fundamental problems within plant 204 that require remedial action.

According to an exemplary embodiment, control loop auditing may include generating an overall index value $I_{DC}$ at the end of each invasive test function 120 that relates to the difficulty in controlling plant 204 with a linear control law such as PID. In one embodiment, the overall index value $I_{DC}$ may be between zero and one, with one meaning that plant 204 will be difficult to control. According to this embodiment, the overall index value $I_{DC}$ may be established based on three sub-indices, including a time delay index $I_{DC}$, a static non-linearity index $I_{SN}$, and a dynamic nonlinearity index $I_{DN}$. A hysteresis index $I_H$ may also be determined.

According to one embodiment, a delay index that may be calculated for plants characterized as FOPTD is given by:

$$\lambda = \frac{L}{L+T}, 0 \le \lambda \le 1 \tag{48}$$

where the denominator in Eq. (48) is the average residence time of plant 204. If λ is close to zero, the time delay is negligible relative to the average residence time and plant 204 will be easy to control. As λ tends toward one, plant 204 becomes a pure time delay system and poor results may be obtained from applying PID control. The time delay index $I_{TD}$ is calculated from a weighted average of the lambda values from all successful steps in a test, i.e.:

$$I_{TD}=w\lambda^T, 0 \leqq I_{TD} \leqq 1 \tag{49}$$

where $\lambda^T=[\lambda_1\ \lambda_n]$; n being the total number of successful step tests, and $w^T=[1\ .\ .\ .\ 1]$ for the extended test and $w^T=[0.25\ 0.75]$ for all other tests.

The static nonlinearity index $I_{SN}$ may be calculated for more than two steps, such as for extended test 124. It is calculated as:

$$I_{SN} = 1 - \frac{\min(|K|)}{\max(|K|)}, \forall |K| > 0 \tag{50}$$

where $0 \leqq I_{SN} \leqq 1$. The index value is zero if there is no gain variation and tends toward one for significant variation. Zero values of gain are obtained in a test if there is some kind of failure, either due to malfunction of plant 204 or a failure of the parameter estimation algorithm.

Extended test 124 exercises plant 204 at strategically selected operating points and provides a sufficient characterization of gain variation. In closed-loop test 125, plant 204 is stepped between two user-selected setpoints. If plant 204 is non-linear, U(s) will cover different parts of the operating range for the step up and step down. Closed-loop test 125 thus provides some opportunity for establishing static non-linearity. In contrast, capacity test 121 and quick tune test 122 exercise plant 204 at exactly the same operating points in each step and would not reveal static non-linearity. However, if hysteresis exists in plant 204, this would get manifested in the gain estimations and in the index value.

As with static non-linearity, dynamic non-linearity directly affects the performance of PID control. Dynamics can change with operating point and with the direction of change in the output of plant 204. Because all of invasive test functions 120 involve stepping plant 204 in both directions, the dynamic nonlinearity index IDN may be calculated from all test results using the average residence time estimates as follows:

$$I_{DN} = 1 - \frac{\min(L+T)}{\max(L+T)} \tag{51}$$

where $0 \leqq I_{DN} \leqq 1$. The index value is zero if there is no variation in the overall dynamics and tends toward one for significant variation.

The overall difficulty of control index $I_{DC}$ is a simple average of the indices described above and may be calculated from:

$$I_{DC}=1/3(I_{TD}+I_{SN}+I_{DN})$$

where $0 \leqq I_{DC} \leqq 1$ with zero indicating a linear and easily controllable plant and values greater than zero indicating non-linear plant characteristics and potential control difficulties. According to an exemplary embodiment, where the static non-linearity is high, a function may be calculated to cancel the non-linearity in feedback control loop 200, as will be described below.

Additionally, a hysteresis index $I_H$ may also be determined as part of control loop auditing in step 350. The difference in the two gains $K_1$ *and* $K_2$ estimated from hysteresis test 123 is proportional to the difficulty of control. Thus, the difficulty of control index due to hysteresis is calculated as:

$$I_H = \frac{K_1 - K_2}{K_1} \tag{53}$$

where $0 \leqq I_H \leqq 1$. The hysteresis index value $I_H$ is zero if there is no hysteresis, and it is equal to one if the slack is greater than or equal to approximately 20 percent.

Hysteresis characterization may also be performed as part of the analysis in step 350. Hysteresis or backlash is a common problem for manipulated devices such as valves and dampers. Hysteresis is also referred to as "play" and "slack" in plant 204. The performance of feedback control loop 200 can be severely affected if a significant amount of slack is present in the manipulated device in plant 204. Thus, hysteresis test 123 is designed to estimate the amount of slack in plant 204. In hysteresis test 123, it is assumed that the maximum amount of slack is present in the middle of the range of U(s) (i.e., at 50 percent). Accordingly, hysteresis test is 123 designed to estimate the slack around this value.

Figure 10:
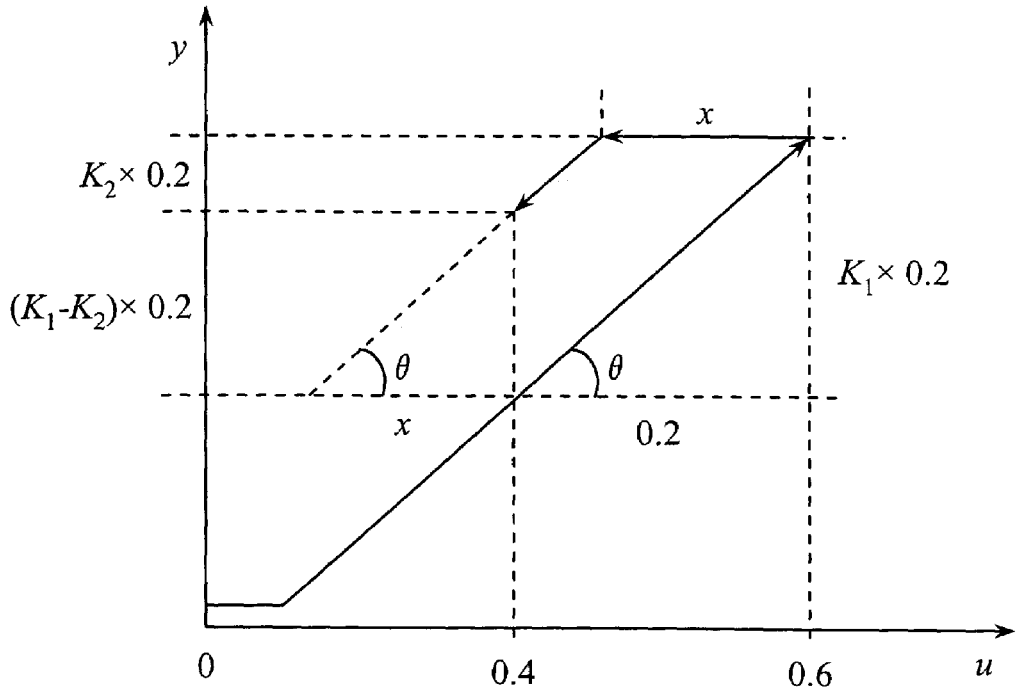
FIG. 10 is a graph which illustrates an input-output plot for the hysteresis test according to an exemplary embodiment.

In hysteresis test 123, U(s) is stepped from 40 percent to 60 percent in order to capture up to 20 percent slack in plant 204 and also reduce the inaccuracy in estimation of the FOPTD parameters due to noise. FIG. 10 illustrates the input-output plot for hysteresis test 123 according to an exemplary embodiment. $K_1$ is the estimated plant gain for the step change from 40 percent to 60 percent, and $K_2$ is the estimated plant gain for the step change from 60 percent to 40 percent. The amount of slack x is given by:

$$\tan(\theta) = \frac{K_1 \times 0.2}{0.2} = \frac{(K_1 - K_2) \times 0.2}{x}. \tag{54}$$

Simplifying Eq (54) results in:

$$x = \frac{(K_1 - K_2)}{K_1} \times 0.2. \tag{55}$$

Thus, the amount of slack x in plant 204 may be calculated using Eq. (55). If the actual amount of slack is greater than 0.2, then $K_2=0$. Accordingly, the maximum amount of slack that can be detected in this way is 0.2. If the amount of slack is greater than 0.1, then it may adversely affect the performance of feedback control loop 200. Also, a large slack may produce inaccurate results for extended test 124.

Characterization and cancellation of static linearity in plant 204 may also be performed as part of the analysis in step 350. Static non-linearity is a common source of control problems in, for example, HVAC systems. The problem exists because most HVAC systems are controlled with PI or PID controllers, which are designed for constant gain systems. The performance of a fixed-parameter PI or PID controller will vary with the gain of plant 204. Feedback control loop 200 can become very sluggish or start oscillating when the gain of plant 204 changes significantly from the value that was used to tune controller 202.

Extended test 124 allows the static non-linearity of plant 204 to be assessed from the gain estimates that are made at different points in the range of U(s) in step 340. The results from extended test 124 may also be used to estimate parameters in a function that characterizes the normalized static non-linearity. The identified function can then be used in feedback control loop 200 to cancel excessive gain variations in plant 204 and allow more consistent control performance to be achieved without having to make any physical changes to plant 204.

Figure 11:
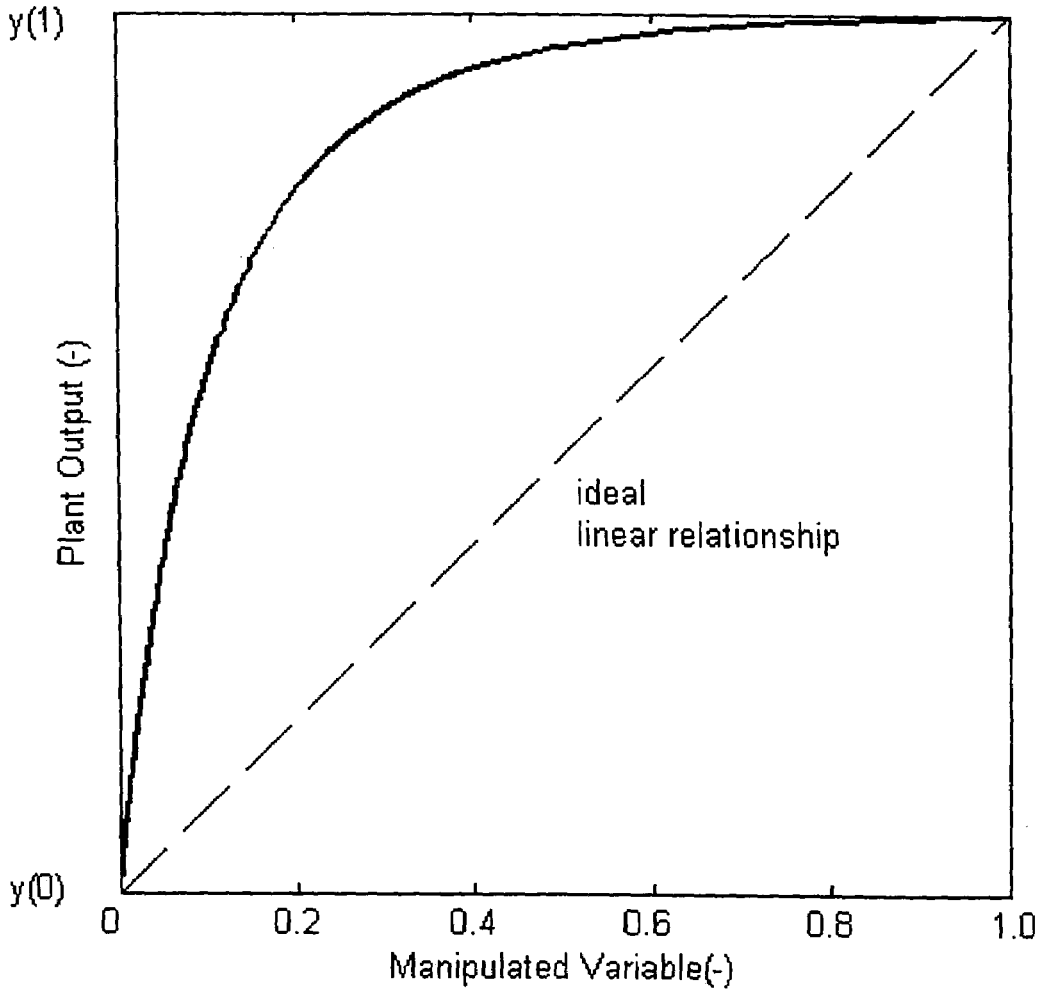
FIG. 11 is a graph which illustrates a typical non-linear relationship for an HVAC system according to an exemplary embodiment.

Static non-linearity may be visualized by plotting the steady-state output of plant 204 against U(s). FIG. 11 illustrates a typical non-linear relationship for an HVAC system according to an exemplary embodiment where most of the gain is experienced at the lower end of the range of U(s).

Figure 12:
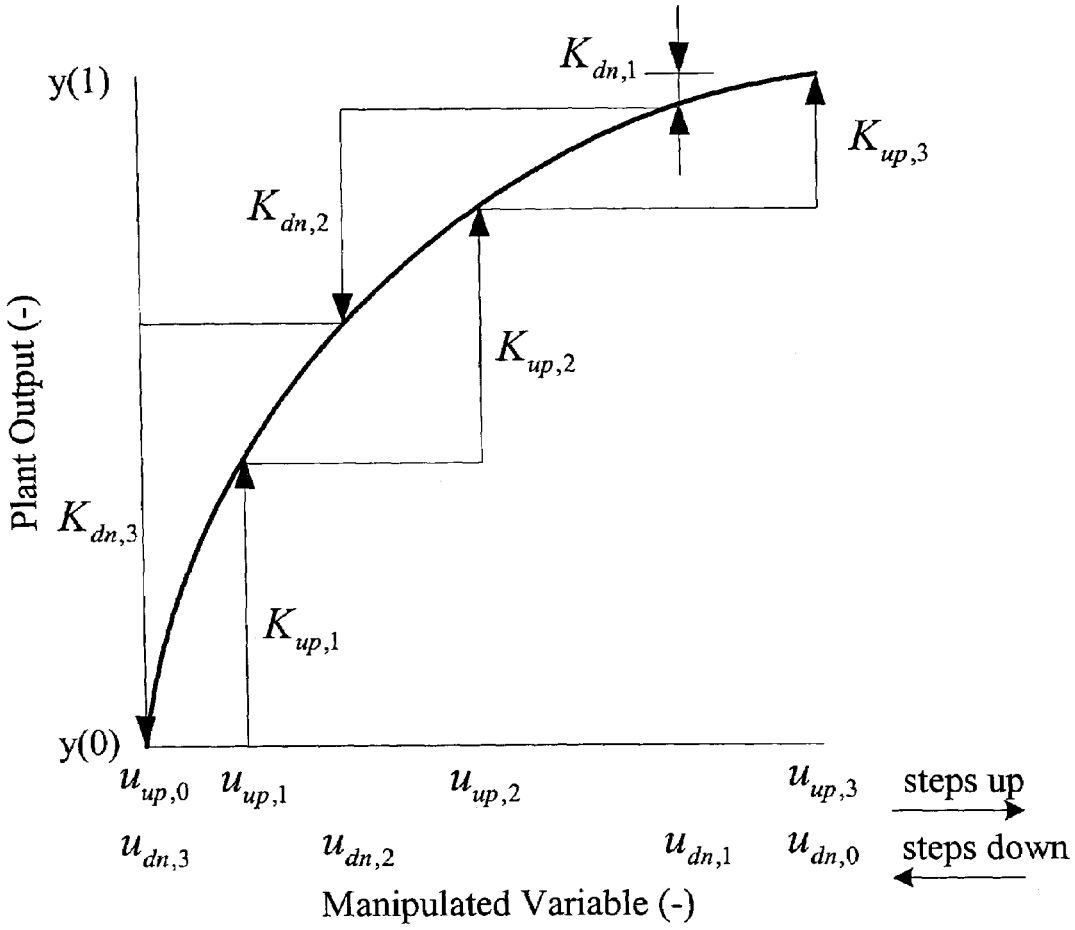
FIG. 12 is a graph which illustrates a stepping sequence for the extended test superimposed on a non-linearity curve for a plant according to an exemplary embodiment.

In extended test 124, U(s) is stepped up from 0 percent–15 percent, 15 percent–60 percent, and 60 percent–100 percent of the range of U(s), and then down from 100 percent–85 percent, 85 percent–40 percent, and 40 percent–0 percent. FIG. 12 shows the stepping sequence of extended test 124 superimposed on a non-linearity curve for plant 204 according to an exemplary embodiment. The gain estimated for each of the up and down steps is denoted as $K_{up,i}$ and $K_{dn,i}$ respectively, where i is a step number. Note that gain relates to $\Delta y/\Delta u$, where $\Delta y$ is the change in the output of plant 204 and $\Delta u$ is the step size in U(s), e.g., $\Delta u = u_{up,1} - u_{up,0}$ for the first step up. The symbol y(0) represents the steady-state output value of plant 204 when the manipulated variable is at 0 and y(1) is the output of plant 204 when the manipulated variable is at 1.0. The up and down steps in extended test 124 give estimates of gain at complementary points in the manipulated variable range. The total range in the output of plant 204 for the steps up is:

$$Y_{range}^{up} = \left| \sum_{i=1}^{n_{up}} K_{up,i}(u_{up,i} - u_{up,i-1}) \right|, \quad \text{where } u_{u,0} = 0 \tag{56}$$

The normalized ready-state values of the output while stepping up ($y_i^{up}$) are then calculated from:

$$y_i^{up} = \frac{\left| \sum_{j=1}^{i} K_{up,j}(u_{up,j} - u_{up,j-1}) \right|}{Y_{range}^{up}}, \quad i = 1, \ldots, n_{up} \tag{57}$$

where, $n_{up}$ is the number of steps up. Similarly, for steps down:

$$Y_{range}^{dn} = \left| \sum_{i=1}^{n_{dn}} K_{dn,i}(u_{dn,i-1} - u_{dn,i}) \right|, \quad \text{where } u_{dn,0} = 1 \tag{58}$$

and $$y_i^{dn} = 1 - \frac{\left| \sum_{j=1}^{i} K_{dn,j}(u_{dn,j-1} - u_{dn,j}) \right|}{Y_{range}^{dn}}, \quad i = 1, \ldots, n_{dn} \tag{59}$$

Ideally the sum of the gains for the steps up should equal the sum of the gains for the steps down and these should also equal the difference between y(0) and y(1). However, differences may exist either due to inaccuracies in the parameter estimation procedure or due to physical effects, such as hysteresis. Use of separate step up and step down summations prevents the possibility of fractional range values being outside of the zero to one range.

The inputs and outputs may be collected as:

$$Y = [y^{up} y^{dn}]$$

$$U = [u^{up} u^{dn}] \tag{60}$$

According to an exemplary embodiment, a plot of Y versus U may be generated so that the user can visualize the static non-linearity of plant 204.

Figure 13:
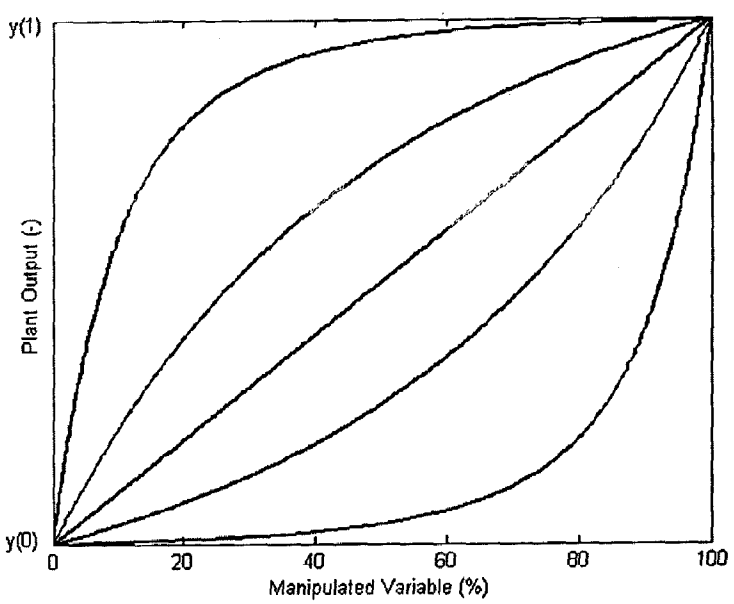
FIG. 13 illustrates an exemplary family of curves that describe typical HVAC system non-linearities.
Figure 13:
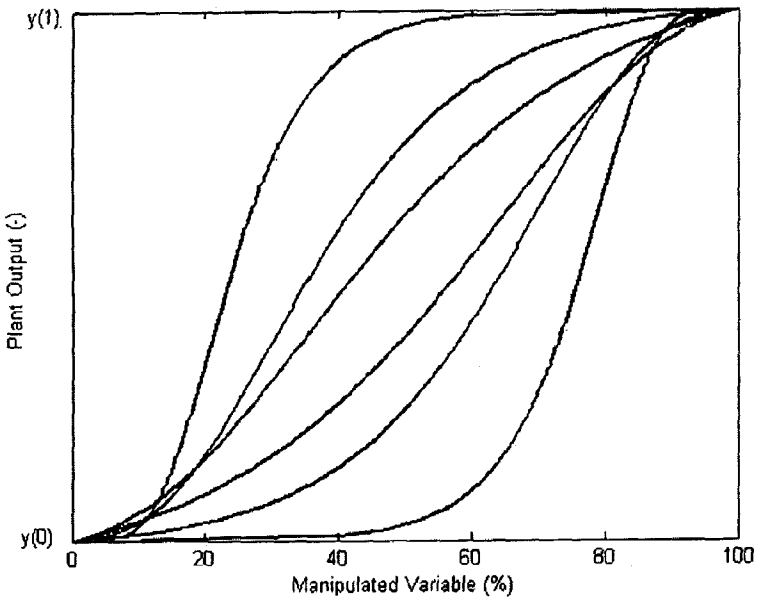

The non-linearity depicted in FIG. 11 can be described by the following exponential relation:

$$f = \frac{1 - \exp(-\beta u)}{1 - \exp(-\beta)}, \ \forall \beta \neq 0 \tag{61}$$

where f is the estimate of fractional gain and β is a 'curvature' parameter such that as $|\beta| \to 0$ the relationship between u and y becomes linear. This function represents the exponential behavior found in many individual HVAC components quite well, but it does not model the more complex behavior found in subsystems that contain multiple components, such as actuator, valve, and heat exchanger combinations. For example, many systems may have 's' shaped characteristics that are often the result of exponential-type behaviors acting in series. FIG. 13 illustrates an exemplary family of curves that more accurately describes typical HVAC system non-linearities. The family of curves depicted in FIG. 13 can be modeled as two exponential functions in series such that:

$$x = \left[ \frac{1 - \exp(-\beta_1 u)}{1 - \exp(-\beta_1)} \right] \quad f = \left[ \frac{1 - \exp(-\beta_2 x)}{1 - \exp(-\beta_2)} \right] \tag{62}$$

where $0 \leqq u \leqq 1$ is (t), (e.g., the time domain equivalent of U(s)) f is the fractional gain, and x is an intermediate variable. Two exponential functions acting in series yield enough complexity to capture typical HVAC static non-linearity to a sufficient degree. Eq. (62) may only be solved when both $\beta_1$ and $\beta_2$ are non-zero, otherwise a linear relation should be substituted. According to an exemplary embodiment, a simplified expression that includes alternative functions for zero values of $\beta_1$ or $\beta_2$ is:

$$f = \begin{cases} \dfrac{1 - e^{-\beta_2\left[\frac{1-e^{-\beta_1 u}}{1-e^{-\beta_1}}\right]}}{1 - e^{-\beta_2}} & \text{if } |\beta_1| > 0 \text{ and } |\beta_2| > 0 \\ \dfrac{1 - e^{-\beta_j u}}{1 - e^{-\beta_j}} & \text{if } \beta_i = 0 \text{ and } |\beta_j| > 0 \\ u & \text{otherwise} \end{cases} \tag{63}$$

The function in Eq. (63) is fitted to the data points obtained from extended test 124. Data from the test are used to estimate the two parameters $\beta_1$ and $\beta_2$. The sum of the squares of the differences between the estimated and measured fractional gain values is minimized as given by:

$$S = \sum_{i=1}^{n_{up}+n_{dn}} (Y(u_i) - f(u_i, \beta_1, \beta_2))^2 \tag{64}$$

The parameter estimates are the values obtained when S is at a minimum, i.e., $[\hat{\beta}_1\ \hat{\beta}_1]=\min(S)$. Because a non-linear iterative search technique must be employed to estimate the optimum parameter values, it is important to start with an accurate initial estimate for the values. The reliability of the non-linear estimation process is influenced by whether the initial values are of the correct sign. According to Eq. (63) there are three possible cases:

1. The curve is always above the f=u axis. This occurs when both $\beta_1$ and $\beta_2$ are positive;
2. The curve is always below the f=u axis. This occurs when both $\beta_1$ and $\beta_2$ are negative; and
3. The curve crosses the f=u axis. This occurs when $\beta_1$ and $\beta_2$ have opposite signs.

According to an exemplary embodiment, correct initial signs for the parameters may be ensured by analyzing the raw data to establish the distribution of points about the f=u axis. Appropriate signs for the initial parameters may then be defined based on the three cases above.

Figure 14:
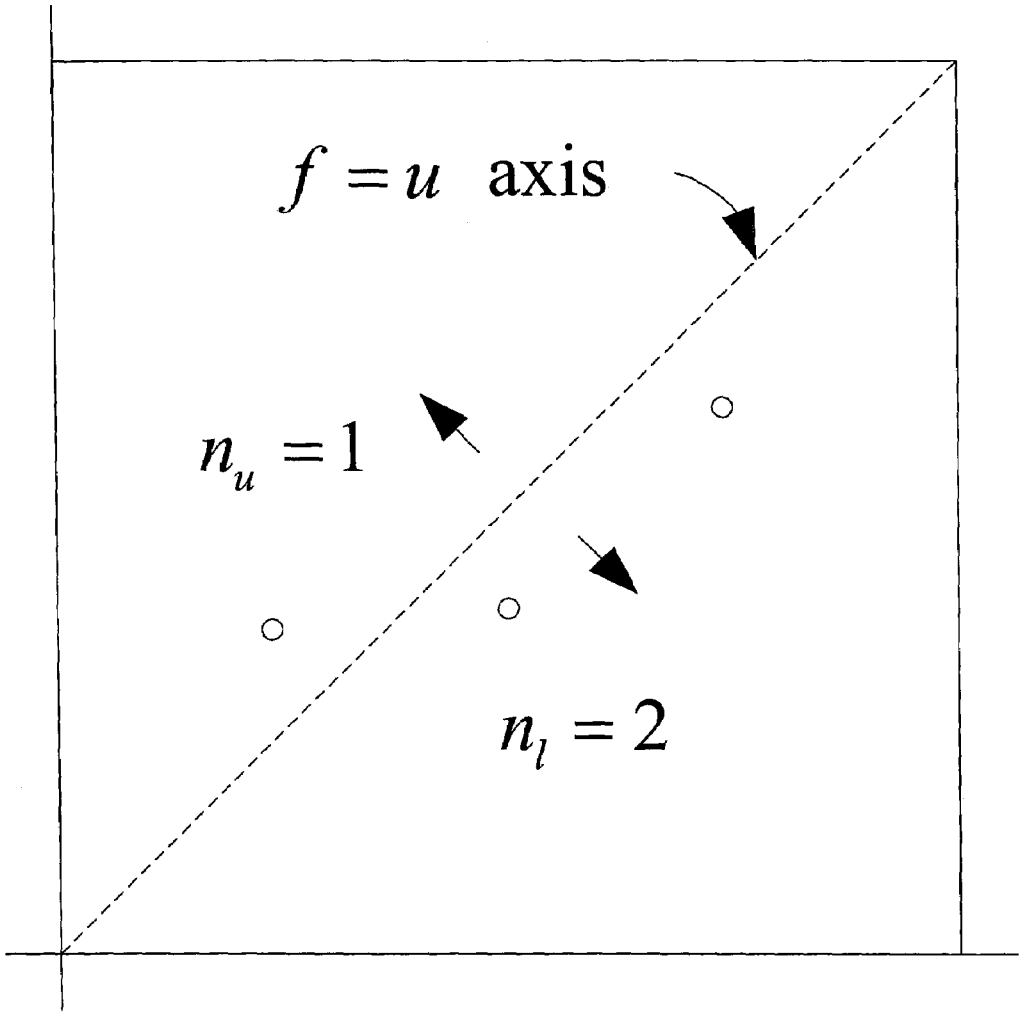
FIG. 14 is a graph which illustrates an exemplary data point distribution.

FIG. 14 shows an exemplary data point distribution where two points fall below the f=u axis, while one lies above. In this case, $\beta_1$ and $\beta_2$ would be initialized to have opposite signs. According to an exemplary embodiment, the magnitude of each of the initial parameter values is set to unity for simplicity.

In order to cancel the non-linearity of plant 204 in control loop 200, the inverse of Equation (63) is sought. The inverse function is given by:

$$u = \begin{cases} \dfrac{-1}{\beta_1}\ln\left(1 + \dfrac{1}{\beta_2}\ln(1 - f(1 - e^{-\beta_2}))(1 - e^{-\beta_1}\right) & \text{if } |\beta_1| > 0 \text{ and } |\beta_2| > 0 \\ 1 - \dfrac{1}{\beta_j}\ln(e^{\beta_j}(1 - f) + f) & \text{if } \beta_i = 0 \text{ and } |\beta_j| > 0 \\ f & \text{otherwise} \end{cases} \tag{65}$$

Figure 15:
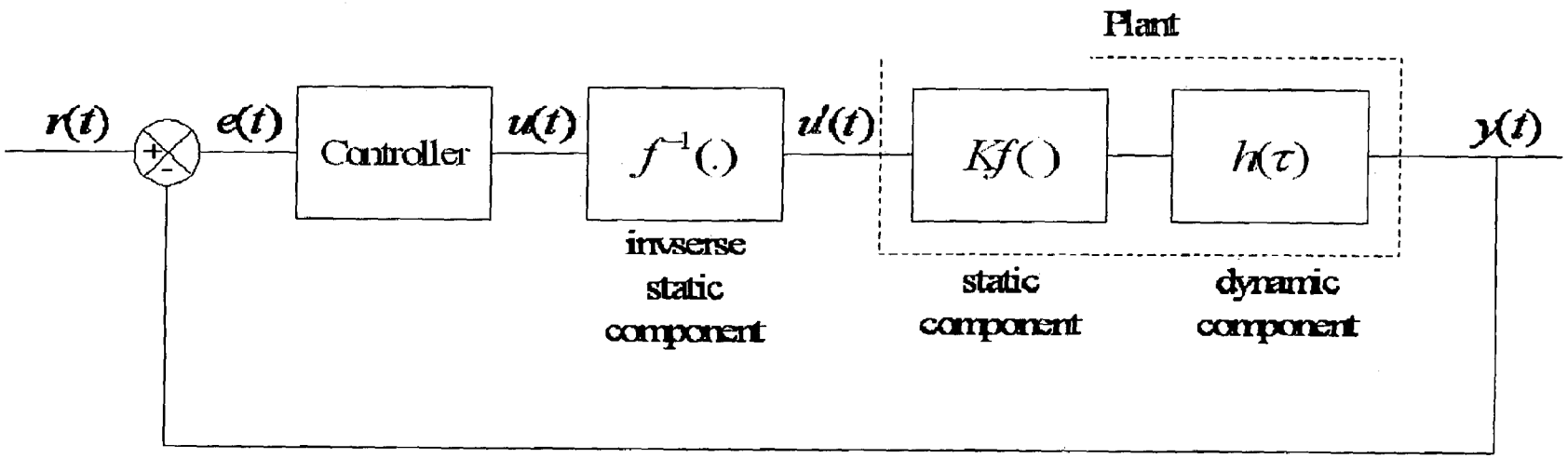
FIG. 15 is a diagram which illustrates an inverse non-linear function incorporated in a control loop according to an exemplary embodiment.

FIG. 15 illustrates the how the inverse non-linear function may be incorporated in feedback control loop 200 according to an exemplary embodiment. Once the non-linearity is included in feedback control loop 200, the static gain of plant 204 should appear constant over the range of U(s).

Figure 16:
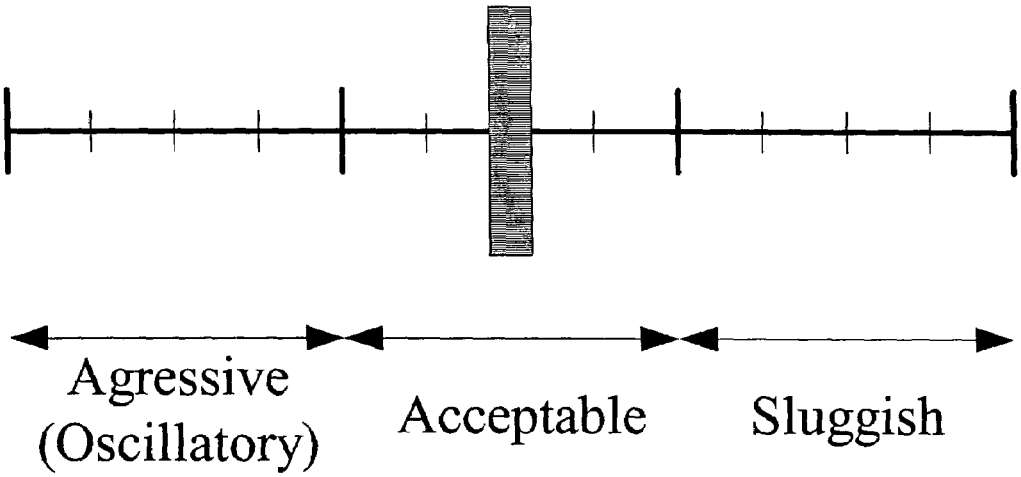
FIG. 16 illustrates a "slider" which may be used to present an index value to a user according to an exemplary embodiment.

Closed-loop response characterization of control loop 200 may also be performed as part of the analysis in step 350. Closed-loop test 125 involves performing two step changes in opposite directions to the controller setpoint signal R(s). The response of feedback control loop 200 is then characterized for each of the two step changes. The objective of the response assessment is to determine an index value that can be presented to the user that indicates how well feedback control loop 200 is tuned. FIG. 16 illustrates a "slider" which may be used to present the index value to the user according to an exemplary embodiment. In the illustrated embodiment, three regions are defined as follows:

1. Aggressive: the response is oscillatory in nature;
2. Acceptable: the response is acceptable; and
3. Sluggish: the response is too slow relative to the dynamics of the controlled plant.

According to an exemplary embodiment, an acceptable response is defined according to criteria, as will be explained below, and an index, $I_r$, is calculated so that acceptable performance is in the range $-1<I_r<1$. The response is considered unacceptably sluggish when $I_r>1$ and too aggressive when $I_r<-1$.

Figure 17:
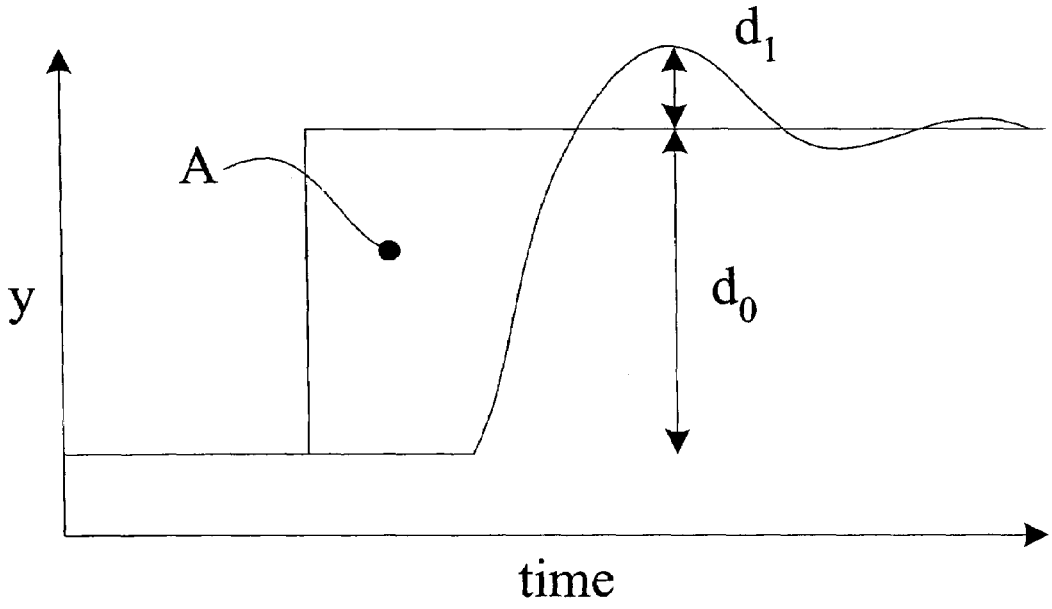
FIG. 17 is a graph which illustrates an exemplary closed-loop response to a setpoint change.

According to one embodiment, the closed-loop response of feedback control loop 200 may be characterized by modeling feedback control loop 200 as second order. Features may be extracted from the response of feedback control loop 200 and then related to the terms in the model. FIG. 17 illustrates an exemplary closed-loop response to a setpoint change (i.e., a step response). Typical features used to characterize step responses include percentage (or fractional) overshoot, rise time, settling time, etc. For an underdamped response, the controlled variable overshoots the setpoint and yields a peak value, which can be used to calculate a fractional overshoot value $\eta$ given by:

$$\eta = \frac{d_1}{d_0} \tag{66}$$

where $d_0$ is the size of the setpoint change and $d_1$ is the magnitude of the overshoot as shown in FIG. 17.

The fractional overshoot is related to the damping ratio $\Sigma$ in a standard second-order model as follows:

$$\eta = \exp\left(\frac{-\pi\xi}{\sqrt{1-\xi^2}}\right) \tag{67}$$

Either the damping ratio or fractional overshoot can be used to express the aggressiveness of the control loop in a normalized way that is independent of information about plant 204. According to an exemplary embodiment, the fractional overshoot may be calculated from the minimum value of error signal observed during the test and the size of the step change according to:

$$\eta = \frac{\min\{e(t)|t_{start} < t < t_{end}\}}{\Delta r}, \tag{68}$$

where $t_{start}$ is the start time for the test, $t_{end}$ is the end time, and $\Delta r$ is the applied change in setpoint. An index that describes the degree of oscillation is:

$$I_o = -\frac{\eta}{\eta_0}, \quad \text{where } I_o \leq 0 \tag{69}$$

where $\eta_0$ defines a limit on the overshoot so that feedback control loop 200 is considered too aggressive if $\eta \geqq \eta_0$. According to an exemplary embodiment, a limit of $\eta_0=0.2$ may be used so that an overshoot of more that 20 percent is considered unacceptable (i.e., yielding an index value of less than one).

Another index value $I_s$ may calculated that describes the sluggishness of the closed-loop response of feedback control loop 200. Because the parameters of plant 204 are estimated during closed-loop test 125, the degree of sluggishness may be calculated in one embodiment by comparing the response dynamics to those of the open-loop plant. For example, the area A in FIG. 17 under the response curve that ignores any under- or over-shoots can be evaluated by ascertaining the maximum value of the integrated error signal. This area is an approximation of the closed-loop average residence time, and is given by:

$$\hat{T}_{ar,loop} = \max\left[\frac{1}{\Delta r}\int_{t_{start}}^{t_{end}} e(t)\,dt\right] \tag{70}$$

where e(t)=rt)−y(t) is the error signal calculated from the setpoint and controller variable. Since feedback control loop 200 cannot respond any faster than the time delay of plant 204, a minimum expected value for $T_{ar,loop}$ is L. An upper bound on $T_{ar,loop}$ defines the maximum tolerable sluggishness. According to one exemplary embodiment, an upper bound may be defined as the time delay plus a multiple of the plant time constant T. Since $t_{end}$ will be a finite value and the error signal may not have completely reached zero, the plant time constant T should be adjusted by integrating over the same interval as in Eq. (70), i.e.:

$$T' = \int_0^{t_{end}-t_{start}-L} e^{-\frac{t}{T}}\,dt, \tag{71}$$

assuming $(t_{end}-t_{start})>L$ $$T' = T\left(1 - \exp\left(\frac{-(t_{end} - t_{start} - L)}{T}\right)\right) \tag{72}$$

Making use of the upper and lower bounds, the sluggishness index $I_s$ may then be calculated as follows:

$$I_s = \frac{T_{ar,loop} - L}{\kappa T'}, \tag{73}$$

where κ is a design parameter determines when the sluggishness index $I_s$ equals the sluggish threshold (+1). The sluggishness index $I_s$ will equal zero when the response is as fast as the plant time delay. According to an exemplary embodiment, κ may be set to 2, which means that the closed-loop response must be slower than 2 times the open-loop response of plant 204 in order for feedback control loop 200 to be considered unacceptably sluggish.

In this way, the method of and apparatus for evaluating the performance of a control system provides automated standardized test procedures which may be carried out in parallel on multiple feedback control loops. Using the method of and apparatus for evaluating the performance of a control system enables a user to automatically assess the performance of a feedback control loop, such as a control loop in an HVAC system, by evaluating the control loop for hysteresis, static or dynamic nonlinearities, etc. Using the method of and apparatus for evaluating the performance of a control system further provides the user with an indication of the overall controllability of a plant or device being controlled. The method of and apparatus for evaluating the performance of a control system also allows a user to cancel the effects of static nonlinearity in a feedback control loop by outputting a mathematical function that can be added to controller that will cancel the non-linearity. This in turn makes the adoption of more rigorous commissioning and troubleshooting more practicable and less time consuming.

Non-Invasive Testing Functions

Referring again to FIG. 1, non-invasive testing functions 130 are configured to assess the performance of a feedback control loop 200 in control system 110, but do not require a step change input to R(s) or any prior information in order to assess the response of feedback control loop 200. In the illustrated embodiment, non-invasive testing functions 130 include load change detection test 131 and oscillation detection test 132. Each non-invasive testing function 120 may be applied in order assess the performance of a particular feedback control loop 200. For example, load change detection test 131 may be used to detect load changes within feedback control loop 200 and to characterize the response of feedback control loop 200 for the load changes. Oscillation detection test 132 may be used to detect sustained oscillations in feedback control loop 200. According to an exemplary embodiment, non-invasive testing functions 130 are configured to work with discrete samples of error signal E(s) from feedback control loop 200 in order to assess its performance, and may be used on a batch of data or online in a recursive fashion.

Load change detection test 131 uses a change detection function for detecting load changes in feedback control loop 200. The change detection function monitors the error signal E(s), where E(s) has an expected value of zero. The change detection function assesses the variability of error signal E(s) and calculates confidence intervals around the expected value of zero. A load change is then detected when error signal E(s) exceeds the limits.

Figure 18:
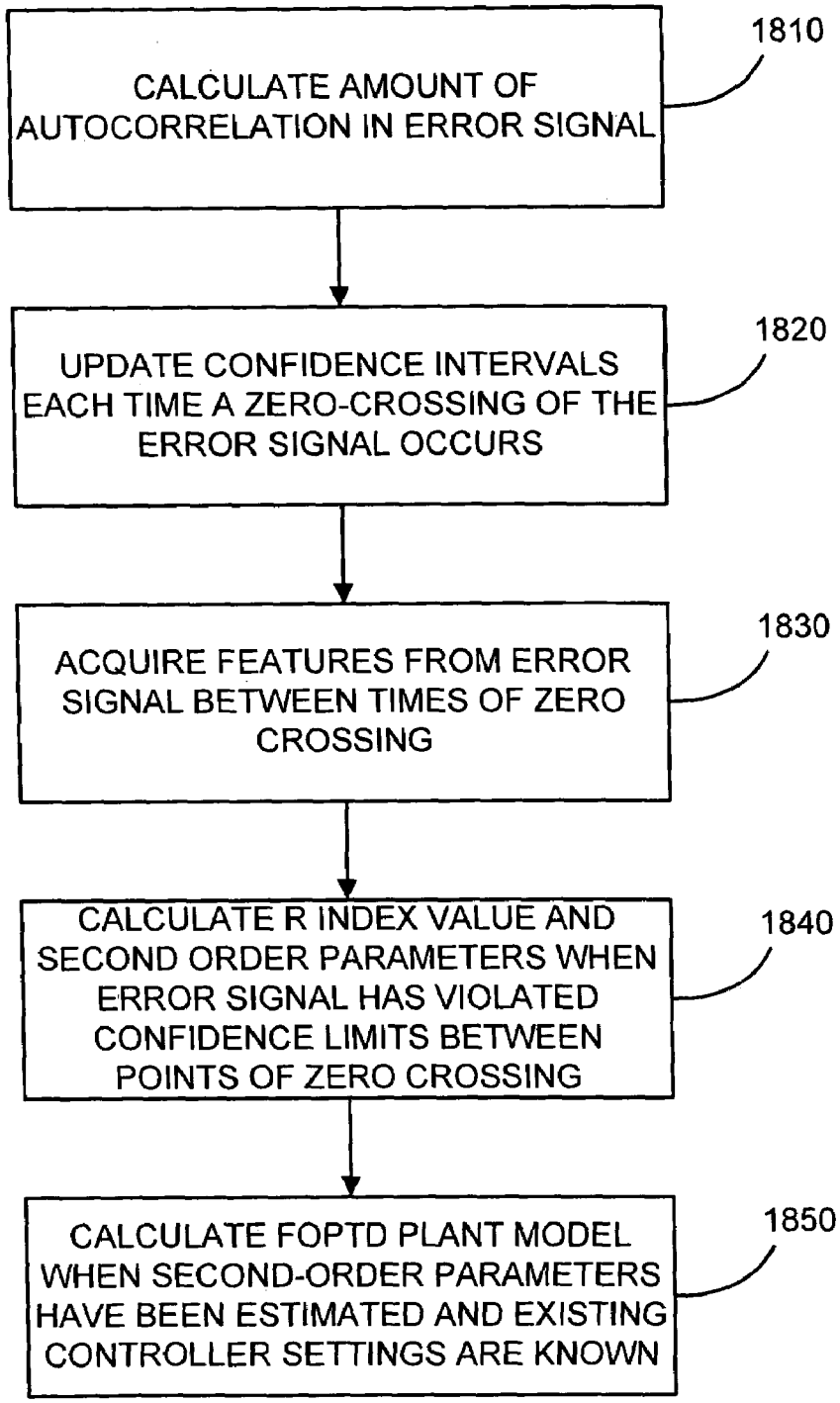
FIG. 18 is a flow diagram which illustrates a general process for detecting load changes and characterizing responses to the load changes according to an exemplary embodiment.

FIG. 18 illustrates a general process which may be used in load change detection test 131 for detecting load changes and characterizing responses to the load changes according to an exemplary embodiment. The process begins with step 1810. In step 1810 the amount of autocorrelation in error signal E(s) is calculated. Feedback control loop 200 will typically be exposed to some unknown mixture of plant and measurement noise (i.e., noise present at the input and output of plant 204 respectively). Error signal E(s) will be autocorrelated to an extent determined by the particular mixture of plant and measurement noise and also the type of controller 202.

An estimate of the lag-one autocorrelation is used as an indication of the extent of autocorrelation in error signal E(s). For a stationary Gaussian time-series, the lag-one autocorrelation may be estimated by counting the number of times E(s) crosses zero. The relationship between zero-crossings and lag-one autocorrelation is expressed through the following "cosine formula":

$$\rho_1=\cos(\pi E[f_{zc}]) \tag{74}$$

where $f_{zc}$ is defined as the number of zero crossings divided by the total number of data samples minus one. Where E(s) is adequately described by an autoregressive AR(1) process, the lag-one autocorrelation value is sufficient to calculate the entire autocorrelation series because $\rho_k=\rho_1\rho_{k-1}$ for k>1.

According to an exemplary embodiment, $f_{zc}$ may be estimated in an adaptive way so that it can track changes in signal properties over time. In this embodiment, $f_{zc}$ may be calculated from an exponentially weighted moving average (EWMA) of the number of samples between zero crossings. An EWMA of the number of samples between zero-crossings may be calculated from:

$$\bar{n}_{zc,k} = \bar{n}_{zc,k-1} + \frac{n_{zc} - \bar{n}_{zc,k-1}}{\min(k, W_1)} \tag{75}$$

where $n_{zc}$ is the number of samples counted between zero-crossing events and $\bar{n}_{zc}$ is an unbiased estimate of the average of this quantity. $W_1$ is the effective number of samples in the moving average window. Allowing the denominator in the update part to initially accumulate until reaching $W_1$ causes the updating to begin as a straight averaging procedure. An estimate of the average zero-crossing frequency is then simply the reciprocal of $\bar{n}_{zc}$, i.e.:

$$\hat{f}_{zc,k} = \frac{1}{\bar{n}_{zc,k}} \tag{76}$$

In one embodiment, because changes in autocorrelation may occur slowly relative to the loop time constant, $W_1$ may be set to a large enough value to ensure statistical reliability.

The autocorrelation reduces the effective number of degrees of freedom in a data set. The number of samples over which autocorrelation persists, i.e. the de-correlation time, determines the effective degrees of freedom. Feedback control loops, such as feedback control loop 200, are ARMA processes wherein autocorrelation does not completely disappear due to the AR terms. According to an exemplary embodiment, a threshold may be selected that defines a period beyond which samples may be sufficiently de-correlated. In this embodiment, in order to estimate the effective degrees of freedom, error signal E(s) is modeled as an autoregressive AR(1) process. In the AR(1) process, past samples are weighted exponentially and the weight of a sample that is d samples old is $\rho_1^d$. A weighting value of κ may be specified as a threshold and the number of previous samples with a weighting greater than the specified value may be calculated from:

$$d = \frac{\ln(\kappa)}{\ln(\rho_1)} \tag{77}$$

According to an exemplary embodiment, a value of 0.05 is used for κ so that samples with weights less then 5% are considered sufficiently de-correlated. The effective degrees of freedom in a set of n samples of the correlated error signal is then:

$$\upsilon = \frac{n}{d} \tag{78}$$

where υ is the effective degrees of freedom.

The variance of error signal E(s) may be calculated from an exponentially-weighted mean-square where the EWMS is given by:

$$s_k^2 = s_{k-1}^2 + \frac{e_k^2 - s_{k-1}^2}{\min(k, dW_2)} \tag{79}$$

where $s^2$ is an unbiased estimate of the variance. The window size for averaging is set to $\upsilon W_2$, where $W_2$ is the desired effective number of degrees of freedom, and the υ term thus extends the averaging window so that it includes the appropriate degrees of freedom given the estimated autocorrelation. As with Eq. (75), the EWMS is set up to begin as a straight averaging procedure until k saturates on $\upsilon W_2$. Use of a moving average allows changes in signal variability to be tracked. According to an exemplary embodiment, the window size $W_2$ may be selected based on the expected rate of change of noise properties. Typically, noise properties will not change very quickly relative to sampling rates and the window size in this embodiment may be set to a high enough value to ensure statistical reliability.

Once an estimate of variance is available, a statistical test is used in step 1820 to detect load disturbances based on the autocorrelation in error signal E(s) by determining a confidence interval for each zero crossing of error signal E(s). According to an exemplary embodiment, a logical null hypothesis is $H_0:\mu=e_k$, where μ is the population mean, which is equivalent to the expected value of zero for the error signal, i.e., μ=0, and $e_k$ is the value of a particular error signal sample. Alternatively, the hypothesis may be $H_1:\mu\neq e_k$. Since the variance is calculated as a moving average with a finite effective window size, the t-statistic is used to account for the finite degrees of freedom according to:

$$t = \frac{e_k - \mu}{s_{\bar{e},k}} \tag{80}$$

where $s_{\bar{e},k}$ is the estimated standard error of the population mean at sample k, which is calculated from the EWMS unbiased estimate of the variance as follows:

$$s_{\bar{e},k} = \sqrt{s_k^2/1} \tag{81}$$

The denominator is one because only one sample $e_k$ is considered. The null hypothesis would then be accepted when:

$$\frac{|e_k|}{s_{\bar{e},k}} < t_{\upsilon,\alpha} \tag{82}$$

where $\alpha$ is a specified alpha risk and the population mean value is set to zero. The number of degrees of freedom is determined from the effective number of samples in the EWMS statistic, such that:

$$\upsilon = \min\left(\frac{k}{2\hat{T}}, W\right) \tag{83}$$

Confidence limits may then be calculated about the expected error value of zero based on a specified alpha risk as follows:

$$CL_{1-\alpha,j} = \pm t_{\alpha,\upsilon_j} s_{\bar{e},j} \tag{84}$$

where j indicates a new zero-crossing event. The limits are updated each time a new zero crossing occurs and transgressions of limits that occur up to the time of the next zero crossing indicate that a load change or disturbance has occurred.

Figure 19:
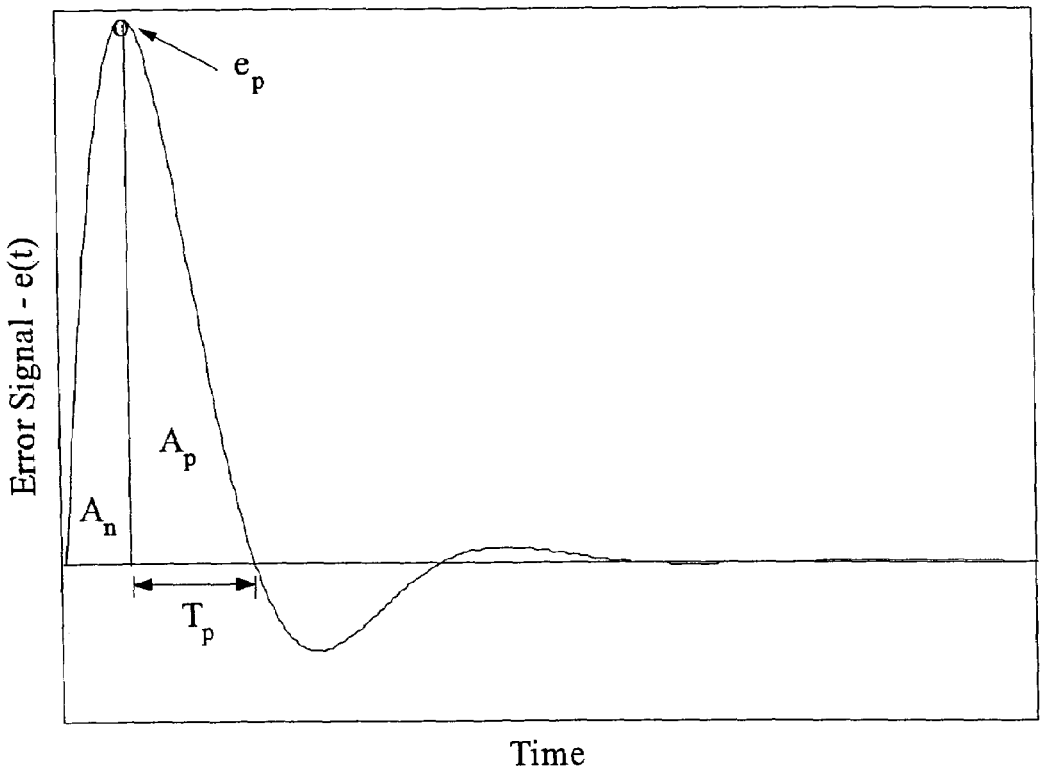
FIG. 19 is a graph which illustrates features acquired from a load disturbance response according to an exemplary embodiment.

In step 1830, features from each load disturbance response (i.e., the error signal) between times of zero crossings are acquired. FIG. 19 illustrates the features acquired from a load disturbance response according to an exemplary embodiment. In the illustrated embodiment, $e_p$ is the peak value of the error signal, $T_p$ is the time between a peak and the next zero crossing, $A_n$ is the area under the error signal curve from the beginning of the response to the time where a peak occurs, and $A_p$ is the area under the error signal curve from the time where a peak occurs until the time of the next zero crossing.

Referring again to FIG. 18, in step 1840, an index value and second order parameters are calculated where error signal E(s) has violated confidence limits between points of zero crossing. According to an exemplary embodiment, a normalized "R" index may be calculated to quantify the aggressiveness of each load disturbance response, and the calculated second order parameters include the damping ratio $\xi$ and the natural frequency $\omega_N$.

The aggressiveness of a load disturbance response relates to how quickly a disturbance is rejected and the controlled variable is brought back to the desired setpoint R(s). Load disturbances are typically manifested as impulse responses on error signal E(s) whereby there will be a time to reach a peak value followed by a time to return to the desired setpoint R(s). According to one embodiment, the aggressiveness of a load disturbance response may be expressed as a ratio of these two times. The time after the peak will become smaller and get closer to the time before the peak as the feedback control loop becomes more aggressive. The amount of setpoint overshoot or undershoot that accompanies increased aggressiveness is dependent on the order of the feedback control loop, where higher-order systems will be able to return to setpoint faster with less overshoot than lower-order systems.

Figure 20:
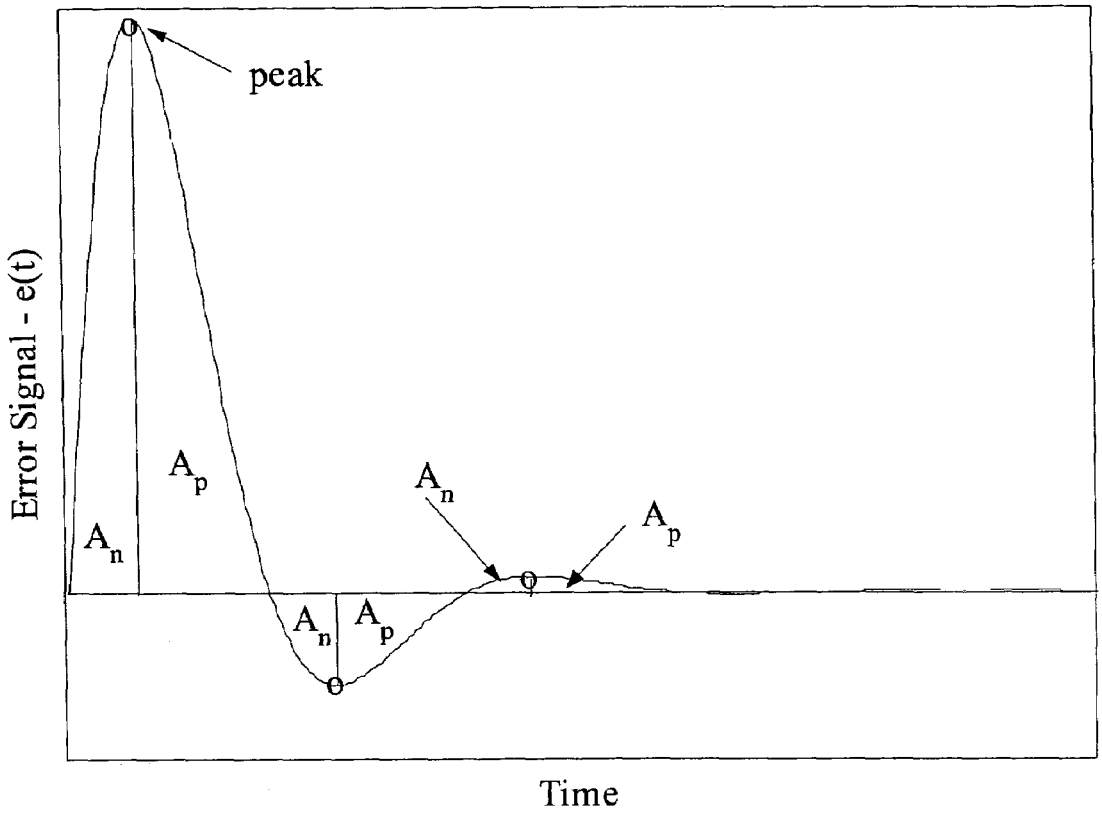
FIG. 20 is a graph which illustrates exemplary areas for an under-damped load disturbance response.

According to an exemplary embodiment, the aggressiveness of a load disturbance response may be calculated using the areas before and after the peak on a response that lies between zero crossings of error signal E(s). FIG. 20 illustrates these areas for an under-damped response. According to this embodiment, an aggressiveness R index value that lies between zero and one may be calculated from the area before the peak divided by the area after the peak, i.e., $$R = \frac{A_n}{A_p} \tag{85}$$

In this embodiment, it is assumed that the control loop is adequately modeled as second order, and that, accordingly, the R index may be related to the damping ratio in the second order model thereby allowing comparison with realistic performance levels.

According to an exemplary embodiment, the damping ratio $\zeta$ may be determined using a second order model of feedback control loop 200. According to this embodiment, a second order model of feedback control loop 200 may be determined by assuming that controller 202 is an integrator and that plant 204 is first order such that:

$$G_c(s) = \frac{1}{s}; \text{ and } G_p = \frac{\omega_N^2}{s + 2\zeta\omega_N} \tag{86}$$

Based on the above definitions, the transfer function for a setpoint change is:

$$\frac{Y(s)}{R(s)} = \frac{G_l(s)}{1 + G_l(s)} = \frac{\omega_N^2}{s^2 + 2\zeta\omega_N s + \omega_N^2} \tag{87}$$

and for a load change:

$$\frac{E(s)}{L(s)} = \frac{G_p(s)}{1 + G_l(s)} = \frac{\omega_N^2 s}{s^2 + 2\zeta\omega_N s + \omega_N^2} \tag{88}$$

For a load change, the transfer function may be specified in terms of the error signal, which is the difference between the setpoint and controlled variable, i.e., E(s)=R(s)−Y(s). $G_1(s)$ is the loop transfer function, which is the product of the controller and plant transfer functions, i.e., $$G_1(s) = G_c(s)G_p(s) \tag{89}$$

Load changes can be modeled as steps acting on the plant input yielding the following expression for error signal E(s):

$$E(s) = \frac{1}{s}\frac{s\omega_N^2}{s^2 + 2\zeta\omega_N + \omega_N^2} \tag{90}$$

Error signal E(s) has the three following time-domain solutions: For $0 \leqq \zeta 1$ (under-damped):

$$e(t) = \frac{\omega_n}{\beta_1}\exp(-\zeta\omega_n t)\sin(\omega_n t\beta_1) \tag{91}$$

For $\zeta=1$ (critically-damped):

$$e(t)=\Omega_n^2 t\ \exp(-\omega_n t) \tag{92}$$

Figure 21:
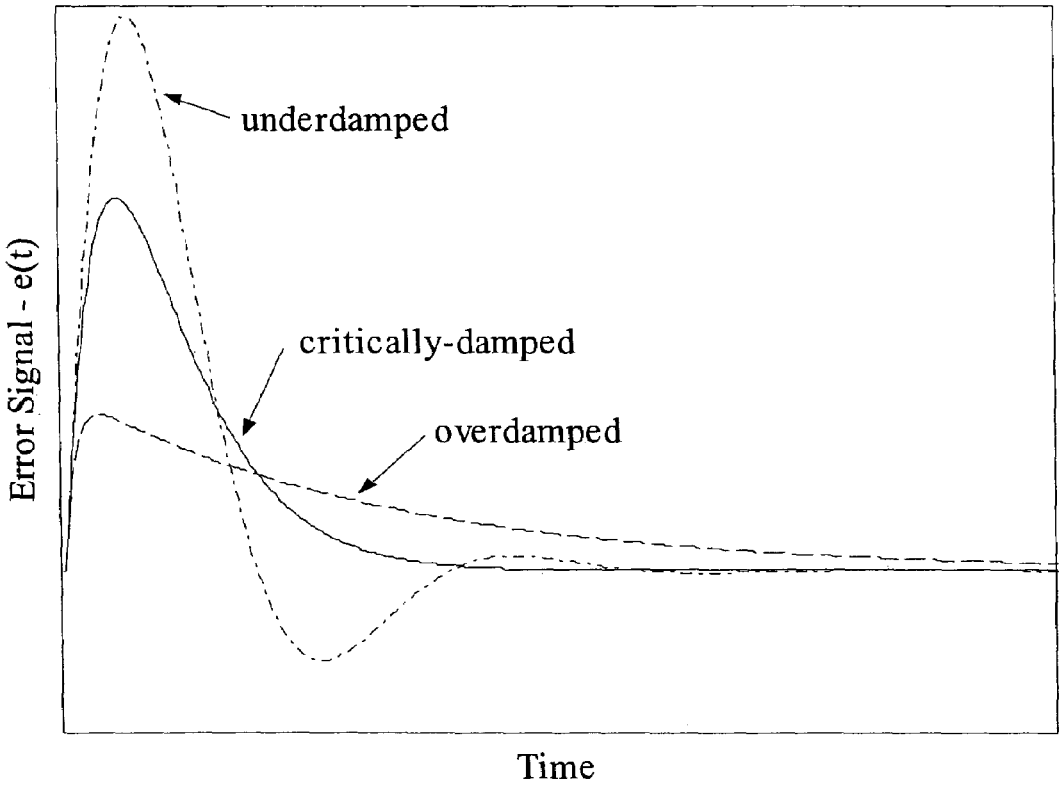
FIG. 21 is a graph which illustrates an exemplary second order under-damped, critically-damped, and over-damped time domain responses.

For $\zeta>1$ (over-damped):

$$e(t) = \frac{\omega_n}{2\beta_2}e^{-(\zeta-\beta_2)\omega_n t} - \frac{\omega_n}{2\beta_2}e^{-(\zeta+\beta_2)\omega_n t} \tag{93}$$

where $\beta_1=\sqrt{1-\zeta^2}$ and $\beta_2=\sqrt{\zeta^2-1}$. FIG. 21 illustrates an exemplary second order under-damped, critically-damped, and over-damped time domain responses for Eqs. (91)–(93).

Since there are three types of load response there are also three different expressions for the areas. These three results are shown below where $A_T$ is the total area from the start of a response to the point where the response crosses zero, for the under-damped case, or when $t\rightarrow\infty$ for the critically- and over-damped cases. $A_n$ is the area under the curve from the beginning of a response to the time when the peak occurs. $A_p$ is simply $A_T$ minus $A_n$. K is the magnitude of load change, which is unknown. For $0 \leqq \zeta < 1$ (under-damped):

$$A_T = K\left[1 + \exp\left(\frac{-\pi\zeta}{\beta_1}\right)\right] \tag{94}$$

$$A_n = K\left[1 - 2\zeta\exp\left(\frac{-\zeta\phi}{\beta_1}\right)\right] \tag{95}$$

where $\phi$=tan $$\phi = \tan^{-1}\left(\frac{\beta_1}{\zeta}\right).$$

. For $\zeta=1$ (critically-damped):

$$A_T=K$$

$$A_n=K[1-2\ \exp(-1)] \tag{97}$$

For $\zeta>1$ (over-damped):

$$A_T=K \tag{98}$$

$$A_n = K\left[1 + \left(\frac{\zeta-\beta_2}{2\beta_2}\right)\left(\frac{\zeta-\beta_2}{\zeta+\beta_2}\right)^{\left(\frac{\zeta+\beta_2}{2\beta_2}\right)} - \left(\frac{\zeta+\beta_2}{2\beta_2}\right)\left(\frac{\zeta-\beta_2}{\zeta+\beta_2}\right)^{\left(\frac{\zeta-\beta_2}{2\beta_2}\right)}\right] \tag{99}$$

Calculation of the R index for all cases cancels K and leaves only a function of the damping ratio given by:

$$R = \frac{A_n}{A_p} = \frac{A_T - A_P}{A_p} = f(\zeta) \tag{100}$$

A value for R can be algebraically determined at the point of critical damping when $\zeta=1$ such that:

$$R_{critical} = \frac{1}{2}\exp(1) - 1 \tag{101}$$

The critically damped value of R represents a realistic benchmark for most practical systems. According to one embodiment, R values may be converted to corresponding damping ratios in order to provide a more standardized measure of controller aggressiveness according to the following third-order polynomials:

$$\zeta = \begin{cases} 0.046335R^3 + 0.50295R^2 - 2.3066R + 1.7572, & \text{for } R > \frac{e}{2} - 1 \\ -0.079147z^3 + 0.0018090z^2 - 0.55061z + 0.34838, & \text{otherwise} \end{cases} \tag{102}$$

where z=ln(R).

The natural frequency $\omega_N$ is also determined in step 1840 as a second order parameter. According to an exemplary embodiment, the parameters $e_p$, $T_p$, $A_n$, and $A_p$ may be used to calculate $\omega_N$ for critically-damped, over-damped, and under-damped load disturbance responses. For $\zeta=1$ (critically-damped):

$$\omega_N = \frac{e_p}{A_T}\exp(1) \tag{103}$$

For $\zeta>1$ (over-damped):

$$\omega_N = \frac{2\beta_2 e_p}{A_T}\left[\left(\frac{\zeta-\beta_2}{\zeta+\beta_2}\right)^{\left(\frac{d-\beta_2}{2\beta_2}\right)} - \left(\frac{\zeta-\beta_2}{\zeta+\beta_2}\right)^{\left(\frac{d+\beta_2}{2\beta_2}\right)}\right]^{-1} \tag{104}$$

where $e_p$ is the peak value of the error signal.

For the under-damped case, the area under the response is dependent on the number of times error signal E(s) has crossed zero following a disturbance. According to an exemplary embodiment, use of $T_p$ from step 1830 allows the natural frequency to be calculated as follows for $0<\zeta<1$ (under-damped):

$$\omega_N = \frac{\pi - \phi}{T_p \beta_1} \tag{105}$$

where $T_p$ is the time between a peak and the next zero crossing.

Referring again to FIG. 18, in step 1850, an FOPTD model for plant 204 may be calculated using the parameters calculated in step 1840. The transfer function for feedback control loop 200 may be expressed as:

$$G_l(s) = G_c(s)G_p(s) = \frac{1}{s}\frac{\omega_n^2}{(s + 2\zeta\omega_n)} \tag{106}$$

The reciprocal of the transfer function for a PI controller is:

$$\frac{1}{G_c(s)} = \frac{T_i s / K_c}{T_i s + 1} \tag{107}$$

The transfer function for plant 204 is given by:

$$G_p(s) = G_l(s)\frac{1}{G_c(s)} = \frac{\omega_n^2}{s(s + 2\zeta\omega_n)}\frac{T_i s / K_c}{(T_i s + 1)} \tag{108}$$

which simplifies to:

$$G_p(s) = \frac{\omega_N^2 / K_c}{\left(s + \frac{1}{T_i}\right)(s + 2\zeta\omega_N)} \tag{109}$$

For $\zeta>0$, use of PI control law yields a second order plant having negative real poles. When $\zeta=0$, one root disappears, making it possible to characterize plant 204 by two parameters rather than three. According to an exemplary embodiment, the second order model in Eq. (109) may be converted into the FOPTD form as defined by:

$$G_{p,FOPTD}(s) = \frac{K_p \exp(-Ls)}{1 + Ts} \tag{110}$$

According to this embodiment, the following identities may by used to achieve a mapping between second order and FOPTD model parameters:

$$T = \sqrt{\frac{G''(0)}{G(0)} - \left[\frac{G''(0)}{G(0)}\right]^2} \tag{111}$$

-continued $$L = \frac{-G'(0)}{G(0)} - T \tag{112}$$

Using the above identities for the plant transfer function defined in Eq. (109) the following expressions may be obtained:

$$K_p = \frac{T_i \omega_N}{2\zeta K_c} \tag{113}$$

$$T = \sqrt{\frac{1}{4\zeta^2\omega_N^2} + T_i^2} \tag{114}$$

$$L = \left(\frac{1}{2\zeta\omega_N} + T_i\right) - T \tag{115}$$

The expressions above allow the three parameters in the FOPTD model to be calculated from the second order loop transfer function and controller parameters when $\zeta>0$. As $\zeta\rightarrow 0$, the static gain tends to infinity as one root disappears in Eq. (116). According to an exemplary embodiment, it may be assumed that plant 204 is FOPTD where the root in the first-order lag part is the known root in Eq. (109). The transfer function of feedback control loop 200 may then be expressed as:

$$\begin{aligned} G_l(s) &= \frac{T_i s + 1}{T_i s / K_c}\frac{K_p \exp(-Ls)}{T_i s + 1} \\ &= K_c \frac{K_p}{T_i s}\exp(-Ls) \end{aligned} \tag{116}$$

The plant pole is cancelled by the integral action of controller 202 and the transfer function of feedback control loop 200 becomes an integrator and time delay in series with a proportional action controller. From Eq. (116), the frequency response is:

$$G_l(i\omega) = \frac{-K_c K_p}{T_i \omega}(i\cos(L\omega) + \sin(L\omega)) \tag{117}$$

According to an exemplary embodiment, it may be assumed that the phase and magnitude are at the critical point, i.e., where $G_1(i\omega)=-1$. The proportional gain value that leads to the loop being at the critical point may be referred to as the ultimate gain $K_u$, and $\omega_u$ is the corresponding ultimate frequency, where:

$$\omega_u = \frac{\pi}{2L} \tag{118}$$

$$K_u = K_c = \frac{T_i \pi}{2K_p L} \tag{119}$$

The damping ratio does not appear in the equations and the three parameters in the FOPTD plant model may be resolved from the natural frequency (which is equivalent to the ultimate frequency when sustained oscillations occur) and the two PI controller parameters according to:

$$K_p = \frac{T_i \omega_N}{K_c} \tag{120}$$

$$L = \frac{\pi}{2\omega_N} \tag{121}$$

$$T = T_i \tag{122}$$

Obtaining a plant model from closed-loop data enables plant performance monitoring and fault detection, and allows calculation of new controller parameters. Isolation of a plant model may also simplify the problem of plant performance monitoring and fault detection. Identification of a plant model also facilitates calculation of controller parameters when closed-loop behavior is unsatisfactory. Accordingly rather than just auditing closed-loop performance, the proposed method also allows identified tuning problems to be rectified.

Referring again to FIG. 1, oscillation detection test 132 may be used to determine whether feedback control loop 200 is in a state of sustained oscillation. Oscillations are periodic changes that cause a signal to vary in a deterministic and repeatable fashion. Oscillation detection test 132 is included in testing tool 100 because sustained oscillations in feedback control loop 200 may not be detected by load change detection test 131, which is designed to detect load disturbances that occur intermittently on top of slowly varying or constant noise variations.

Figure 22:
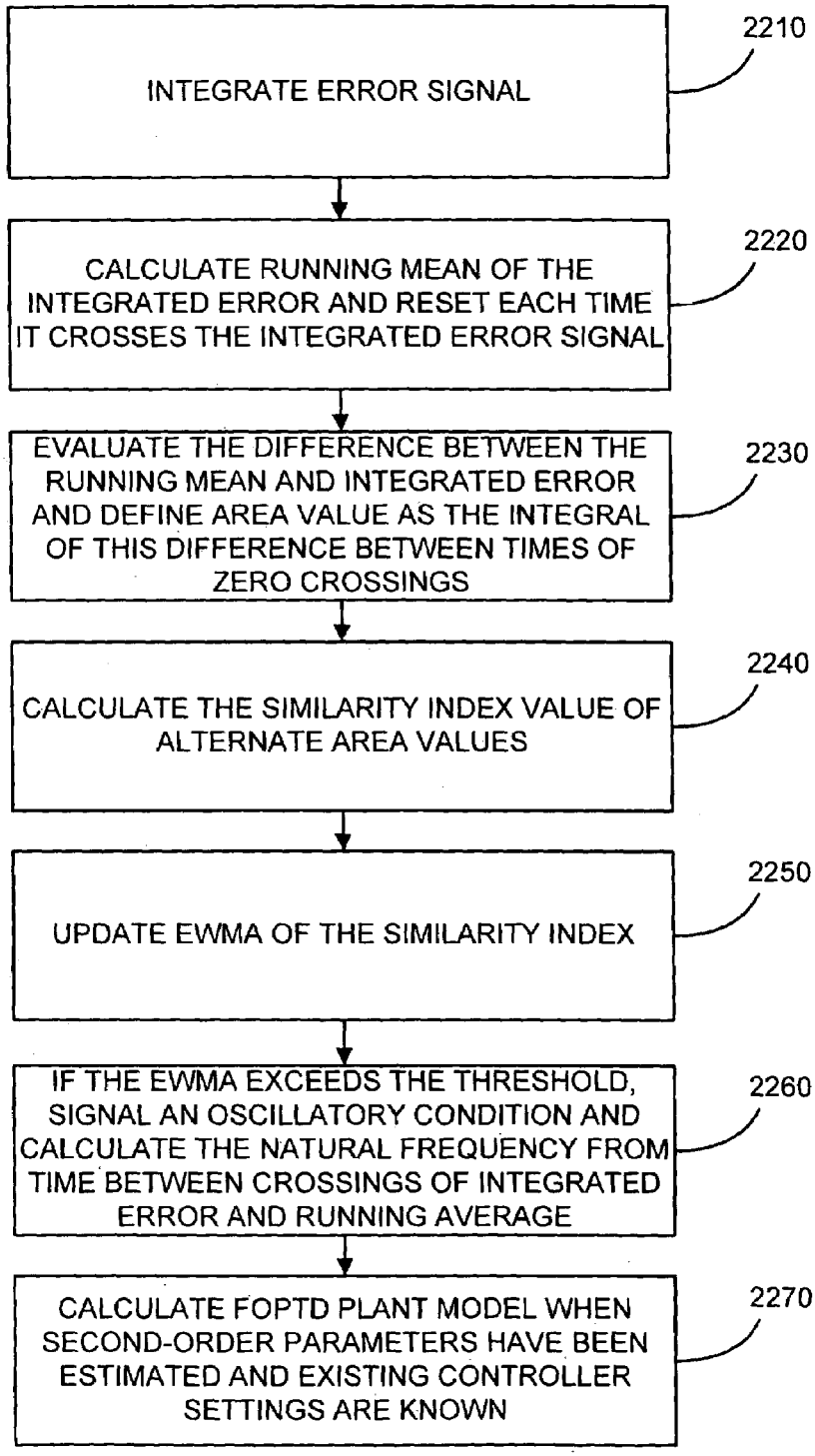
FIG. 22 is a flow diagram which illustrates a process for detecting sustained oscillations in the feedback control loop of FIG. 2 according to an exemplary embodiment.

FIG. 22 illustrates a process for detecting sustained oscillations in feedback control loop 200 by detecting repeating patterns in error signal E(s) according to an exemplary embodiment. In this embodiment, the process seeks to identify similarity of alternating areas under error signal e(t) in the time domain in order to reduce the effects of nonlinearities and higher-order terms in e(t). The process begins with step 2210. In step 220, error signal e(t) is integrated in the time domain according to:

$$I(t) = \int_0^t e(t)\,dt \tag{123}$$

where I(t) is the integral of error signal e(t) at time t. The integration function of Eq. (123) reduces the impact of high frequency noise in error signal e(t) on the number of zero crossings in error signal e(t) such that only zero crossings due to oscillations remain.

In step 2220, a running mean of the integrated error signal of Eq. (123) is calculated and reset each time the integrated error signal I(t) crosses it. The running mean is calculated as an estimate of the expected value of error signal e(t). because the expected value of the integrated error signal I(t) of Eq. (123) is no longer zero, and this impacts the determination of a "zero crossing" for error signal e(t). Because the expected value can change, the running mean is reset every time the integrated error I(t) crosses it. The average value of the integrated error signal I(t) up to time t between zero-crossings is:

$$\bar{I}(t) = \frac{1}{t - t_j} \int_{t_j}^{t_{j+1}} I(t)\,dt \tag{124}$$

where $t_j$ and $t_{j+1}$ are times of successive zero crossings. In discrete time, a running average may be calculated from:

$$\bar{I}_j = \bar{I}_{j-1} + \frac{I_k - \bar{I}_{j-1}}{j} \tag{125}$$

where j>0 is now the number of samples since the last zero-crossing and k denotes sample number.

In step 2230, the difference between the running mean and the integrated error I(t) is calculated, and an area value is defined as the integral of the difference between the times of zero crossings. By defining the error between the running average and the actual value as:

$$E_1(t) = \bar{I}(t) - (t) \tag{126}$$

a zero crossing of the integrated error signal then occurs when $E_I(t)$ crosses zero. A new area quantity can then be calculated from $E_I(t)$ such that:

$$A_j = \int_{t_j}^{t_{j+1}} E_I(t)\,dt \tag{127}$$

where $t_j$ and $t_{j+1}$ are now times of successive zero crossings of $E_I(t)$.

Figure 23:
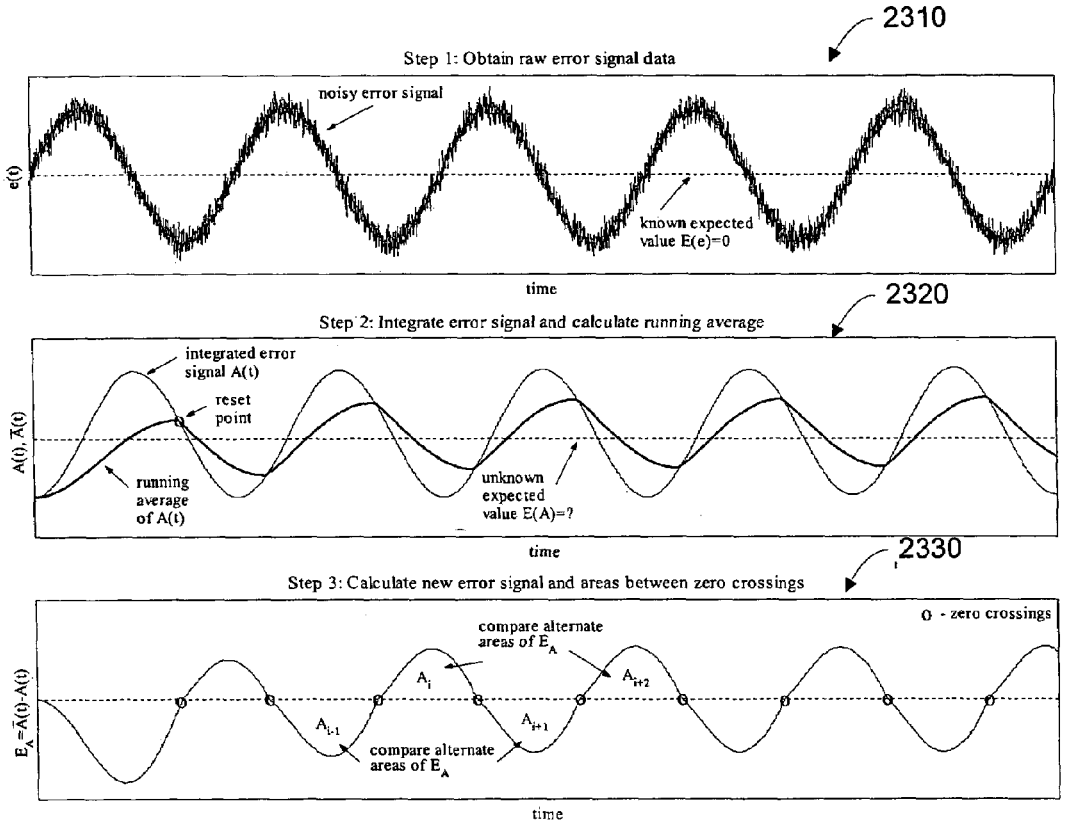
FIG. 23 is a series of graphs which illustrate the different signal processing steps performed in the oscillation detection test in order to obtain area values according to an exemplary embodiment.

FIG. 23 graphically illustrates the different signal processing steps performed in order to obtain the area values and shows application to a noisy oscillating error signal according to an exemplary embodiment. A first graph 2310 illustrates the raw error signal e(t) data prior to step 2210. A second graph 2320 illustrates the integrated error signal I(t) and running average of the integrated error signal according to step 2220. A third graph 2330 illustrates the error signal $E_I(t)$ representing the difference between the running mean and the integrated error signal I(t), as well as the area between zero crossings according to step 2230.

Referring again to FIG. 22, in step 2240 a similarity index value of alternate area values is calculated. According to an exemplary embodiment, a similarity measure that is normalized between zero and one is given by:

$$S(A_i, A_{i-2}) = \frac{\min(|A_i|, |A_{i-2}|)}{\max(|A_i|, |A_{i-2}|)} \tag{128}$$

where $0 \leqq S(.) \leqq 1$ is the similarity index value.

In step 2250, the EWMA of the similarity index is updated. According to an exemplary embodiment, the average similarity index value may be calculated over a window of samples in order to test for an oscillating condition.

According to this embodiment, an EWMA may be adopted so that:

$$\bar{S}_k = \bar{S}_{k-1} + \frac{S_k - \bar{S}_{k-1}}{W_3} \tag{129}$$

where $\bar{S}_k$ is the EWMA of the similarity index taken over an effective window size of $W_3$ pairs of alternate area values. Because of noise and other effects such as non-linearities, the similarity index will be unlikely to have an asymptotic value of unity for oscillating changes. Thus, according to an exemplary embodiment, $\bar{S}_k$ may be compared against a near-unity threshold to detect oscillations. The choice of threshold will affect the sensitivity of the detection method. Another factor that will affect sensitivity is the size of the averaging window, which may be determined by the $W_3$ parameter in Equation (129). For random changes, runs of near-unity similarity index values will occur, but the probability decreases with increasing run length. Accordingly, increasing the window size $W_3$ will reduce the chance that the $\bar{S}_k$ value will approach unity for random changes, but will also make it slower to respond to real periodic changes. According to an exemplary embodiment, suitable values may be obtained empirically by testing the procedure with real data, such as data from non-linear, noisy, and oscillating control loops in buildings. For example, in one embodiment, satisfactory sensitivity may be obtained when the threshold on $\bar{S}_k$ is 0.75 and $W_3$. The frequency of oscillations is easily ascertained from the time between zero-crossing points of $E_I(t)$.

In step 2260, an oscillatory condition is signaled to the user if the EWMA exceeds the threshold, and the natural frequency is calculated from the time between crossings of the integrated error I(t) and the running average. In step 2270, an FOPTD plant model is calculated when the second order parameters have been estimated and existing controller settings are known, which is similar to step 1850 shown in FIG. 18 and described with respect to the load change detection test.

In this way, the method of and apparatus for evaluating the performance of a control system provides not only invasive testing techniques, but also non-invasive testing techniques which do not disturb normal operation of the control system. The method of and apparatus for evaluating the performance of a control system also requires no prior information about a particular feedback control loop.

It should be understood that the construction and arrangement of the elements of the exemplary embodiments are illustrative only. Although only a few embodiments of the present invention have been described in detail in this disclosure, many modifications are possible without materially departing from the novel teachings and advantages of the subject matter recited in the claims. Accordingly, all such modifications are intended to be included within the scope of the present invention as defined in the appended claims. Unless specifically otherwise noted, the claims reciting a single particular element also encompass a plurality of such particular elements. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the exemplary embodiments without departing from the spirit of the present invention as expressed in the appended claims.

What is claimed is:

1. A method of evaluating the performance of a control system the method comprising:

receiving data from the control system, wherein the data is received by a passive testing function; and calculating a parameter related to the performance of the control system using the passive testing function;

wherein the passive testing function is a load disturbance detection test, and wherein calculating the parameter related to the performance of the control system includes determining an autocorrelation value from data received from the control system.

2. The method of claim 1, wherein calculating the parameter related to the performance of the control system further includes determining a confidence interval from data received from the control system.

3. The method of claim 2, wherein calculating the parameter related to the performance of the control system further includes determining a normalized index value when data received from the control system exceeds the confidence interval.

4. The method of claim 3, wherein calculating the parameter related to the performance of the control system further includes determining a first-order-plus-time-delay model for a device in the control system.

5. A method of evaluating the performance of a control system, the method comprising:

receiving data from the control system, wherein the data is received by a passive testing function; and calculating a parameter related to the performance of the control system using the passive testing function, wherein the passive testing function is an oscillation detection test, and wherein calculating the parameter related to the performance of the control system includes determining repeating patterns from data received from the control system; and wherein data received from the control system includes an error signal, and wherein determining the repeating patterns from data received from the control system includes determining a similarity index value related to alternating area values associated with the error signal.

6. The method of claim 5, wherein the control system includes a feedback control loop comprising a controller and a plant.

7. A method of evaluating the performance of a control system, the method comprising:

receiving data from the control system, wherein the data is received by a passive testing function; and calculating a parameter related to the performance of the control system using the passive testing function;

wherein the control system includes a feedback control loop comprising a controller and a plant; and wherein the controller is a proportional plus integral (PI) controller.

8. The method of claim 7, wherein the passive testing function is at least one of a load disturbance detection test and an oscillation detection test.

9. The method of claim 8, wherein the passive testing function is an oscillation detection test, and wherein calculating the parameter related to the performance of the control system includes determining repeating patterns from data received from the control system.

10. The method of claim 7, wherein the control system is a heating, ventilating, and air conditioning system.

11. The method of claim 7, further comprising displaying the parameter related to the performance of the control system to a user.

12. The method of claim 7, wherein data received from the control system includes discrete data samples of an error signal associated with the control system.

13. The method of claim 7, wherein the passive testing function is a non-invasive testing function.

14. An apparatus for evaluating the performance of a control system, the apparatus comprising:

a processor operable to execute a passive testing function, wherein the passive testing function is configured to:

receive data from the control system; and calculate a parameter related to the performance of the control system;

wherein the passive testing function is a load disturbance detection test, and wherein calculating the parameter related to the performance of the control system includes determining an autocorrelation value from data received from the control system.

15. The apparatus of claim 14, wherein calculating the parameter related to the performance of the control system further includes determining a confidence interval from data received from the control system.

16. The apparatus of claim 15, wherein calculating the parameter related to the performance of the control system further includes determining a normalized index value when data received from the control system exceeds the confidence interval.

17. The apparatus of claim 16, wherein calculating the parameter related to the performance of the control system further includes determining a first-order-plus-time-delay model for a device in the control system.

18. An apparatus for evaluating the performance of a control system, the apparatus comprising:

a processor operable to execute a passive testing function, wherein the passive testing function is configured to:

receive data from the control system; and calculate a parameter related to the performance of the control system;

wherein the passive testing function is an oscillation detection test, and wherein calculating the parameter related to the performance of the control system includes determining repeating patterns from data received from the control system; and wherein data received from the control system includes an error signal, and wherein determining the repeating patterns from data received from the control system includes determining a similarity index value related to alternating area values associated with the error signal.

19. The apparatus of claim 18, wherein the control system includes a feedback control loop comprising a controller and a plant.

20. An apparatus for evaluating the performance of a control system, the apparatus comprising:

a processor operable to execute a passive testing function, wherein the passive testing function is configured to:

receive data from the control system; and calculate a parameter related to the performance of the control system;

wherein the control system includes a feedback control loop comprising a controller and a plant; and wherein the controller is a proportional plus integral (PI) controller.

21. The apparatus of claim 20, wherein the passive testing function is at least one of a load disturbance detection test and an oscillation detection test.

22. The apparatus of claim 21, wherein the passive testing function is an oscillation detection test, and wherein calculating the parameter related to the performance of the control system includes determining repeating patterns from data received from the control system.

23. The apparatus of claim 20, wherein the control system is a heating, ventilating, and air conditioning system.

24. The apparatus of claim 20, further comprising a display configured to display the parameter related to the performance of the control system to a user.

25. The apparatus of claim 20, wherein data received from the control system includes discrete data samples of an error signal associated with the control system.

26. The apparatus of claim 20, wherein the processor is further operable to execute an active testing function.

27. The apparatus of claim 26, wherein the active testing function is configured to identify static nonlinearity in the control system.

28. The apparatus of claim 26, wherein the active testing function is configured to determine an overall performance index for the control system.

29. The apparatus of claim 26, wherein the active testing function is configured to identify dynamic nonlinearity in the control system.

30. The apparatus of claim 20, wherein the passive testing function is a non-invasive testing function.

31. An apparatus for evaluating the performance of a control system, the apparatus comprising:

a processor operable to execute a passive testing function, wherein the passive testing function is configured to:

receive data from the control system; and calculate a parameter related to the performance of the control system;

wherein the processor is further operable to execute an active testing function;

wherein the active testing function is configured to identify static nonlinearity in the control system; and wherein the active testing function is further configured to determine a mathematical function to remove the static nonlinearity from the control system.

32. An apparatus for evaluating the performance of a control system, the apparatus comprising:

a processor operable to execute a passive testing function, wherein the passive testing function is configured to:

receive data from the control system; and calculate a parameter related to the performance of the control system;

wherein the processor is further operable to execute an active testing function; and wherein the active testing function is configured to determine a first-order-plus-time-delay model for a device in the control system.

33. An apparatus for evaluating the performance of a control system, the apparatus comprising:

means for executing a passive testing function, wherein the passive testing function is configured to:

receive data from the control system; and calculate a parameter related to the performance of the control system;

wherein the passive testing function is a load disturbance detection test, and wherein calculating the parameter related to the performance of the control system includes determining an autocorrelation value, from data received from the control system.

34. The apparatus of claim 33, wherein calculating the parameter related to the performance of the control system further includes determining a confidence interval from data received from the control system.

35. The apparatus of claim 34, wherein calculating the parameter related to the performance of the control system further includes determining a normalized index value when data received from the control system exceeds the confidence interval.

36. The apparatus of claim 35, wherein calculating the parameter related to the performance of the control system further includes determining a first-order-plus-time-delay model for the control system.

37. An apparatus for evaluating the performance of a control system, the apparatus comprising:

means for executing a passive testing function, wherein the passive testing function is configured to:

receive data from the control system; and calculate a parameter related to the performance of the control system:

wherein the passive testing function is an oscillation detection test, and wherein calculating the parameter related to the performance of the control system includes determining repeating patterns from data received from the control system; and wherein data received from the control system includes an error signal, and wherein determining the repeating patterns from data received from the control system includes determining a similarity index value related to alternating area values associated with the error signal.

38. The apparatus of claim 37, wherein the control system includes a feedback control loop comprising a controller and a plant.

39. An apparatus for evaluating the performance of a control system, the apparatus comprising:

means for executing a passive testing function, wherein the passive testing function is configured to:

receive data from the control system; and calculate a parameter related to the performance of the control system;

wherein the control system includes a feedback control loop comprising a controller and a plant; and wherein the controller is a proportional plus integral (PI) controller.

40. The apparatus of claim 39, wherein the passive testing function is at least one of a load disturbance detection test and an oscillation detection test.

41. The apparatus of claim 40, wherein the passive testing function is an oscillation detection test, and wherein calculating the parameter related to the performance of the control system includes determining repeating patterns from data received from the control system.

42. The apparatus of claim 39, wherein the control system is a heating, ventilating, and air conditioning system.

43. The apparatus of claim 39, further comprising means for displaying the parameter related to the performance of the control system to a user.

44. The apparatus of claim 39, wherein data received from the control system includes discrete data samples of an error signal associated with the control system.

* * * * *